US009225118B2

(12) United States Patent
Wang

(10) Patent No.: US 9,225,118 B2
(45) Date of Patent: Dec. 29, 2015

(54) UNIVERSAL SERIAL BUS CONNECTOR

(71) Applicant: ADVANCED-CONNETEK INC., New Taipei (TW)

(72) Inventor: Wen-Yu Wang, New Taipei (TW)

(73) Assignee: ADVANCED-CONNETEK INC., New Taipei (TW)

( * ) Notice: Subject to any disclaimer, the term of this patent is extended or adjusted under 35 U.S.C. 154(b) by 0 days.

(21) Appl. No.: 14/306,946

(22) Filed: Jun. 17, 2014

(65) Prior Publication Data

US 2014/0370729 A1 Dec. 18, 2014

Related U.S. Application Data

(60) Provisional application No. 61/836,794, filed on Jun. 19, 2013.

(30) Foreign Application Priority Data

Jun. 18, 2013 (TW) ..... 102121460 A

(51) Int. Cl.

| | |
|---|---|
| ***H01R 24/00*** | (2011.01) |
| ***H01R 13/6471*** | (2011.01) |
| ***H01R 12/72*** | (2011.01) |
| ***H01R 13/6467*** | (2011.01) |

(52) U.S. Cl.
CPC ..... *H01R 13/6471* (2013.01); *H01R 12/724* (2013.01); *H01R 13/6467* (2013.01)

(58) Field of Classification Search
USPC ..... 439/660, 941
See application file for complete search history.

(56) References Cited

U.S. PATENT DOCUMENTS

| | | | | |
|---|---|---|---|---|
| 7,972,151 | B2 * | 7/2011 | He et al. | 439/108 |
| 8,079,854 | B2 * | 12/2011 | He et al. | 439/108 |
| 8,202,120 | B2 * | 6/2012 | Ko | 439/607.35 |

* cited by examiner

*Primary Examiner* — Tho D Ta
(74) *Attorney, Agent, or Firm* — Muncy, Geissler, Olds & Lowe, P.C.

(57) ABSTRACT

The present device is a Universal Serial Bus (USB) connector which includes a first terminal set and a second terminal set. By increasing the width of a connection portion of a ground terminal of the second terminal set, and bending two pairs of the signal terminal within the second terminal set toward one side respectively and surrounding two sides of the ground terminal connecting section so as to let two pairs of the signal terminals away from the signal terminals in the first terminal set so as avoid the crosstalk interference caused by the first pair of the signals terminals in the second pair of the signal terminals and the third pair of the signal terminals to stabilize the transmission.

11 Claims, 20 Drawing Sheets

UNIVERSAL SERIAL BUS CONNECTOR

FIELD OF THE INVENTION

The present invention relates to a field of USB connector, and more particularly relates to a USB connector able to avoid or reduce crosstalk interference.

BACKGROUND OF THE INVENTION

Universal Serial Bus (USB) connector is a serial bus standard of a connection between 3C device and a peripheral device and also a technique specification for an input/output interface. The USB connector is widely used in 3C device (for example an information communication device (such as a personal computer, a mobile device and so on), a camera device, a digital TV, a game machine and so on). Accordingly, the USB connector is divided into a USB receptacle connector and a USB plug connector. The USB receptacle connector is installed in the electronic devices described above and the USB plug connector is electrically connected to the connecting cable for information transmission. Therefore, the most signification advantage of the USB connector is hot-plugging and plug-and-play. Since USB 1.0 is released in 1996, the transmission speed thereof is 12 Mbit/s and USB 2.0 is improved to be 480 Mbit/s (Hi-speed). And now, USB 3.0 is 5 Mbit/s (super-speed) and the transmission speed is much faster and supported duplex transmission, fiber transmission and so on.

The design of the USB 3.0 is not to replace USB 2.0 and is to upgrade and assistant capability thereof. If the product includes a USB 2.0 interface, only USB 2.0 capability is required. Therefore, from a view of transmission interface technique, both are two different protocols. Accordingly, in order to downward compatibility, the hardware, software and connector for USB 2.0 and USB 3.0 are designed to be similar and USB 2.0 and USB 3.0 can be compatible to each other.

Please refer to FIG. 1A, it is a view illustrating a USB receptacle connector in prior art. As shown in FIG. 1A, a regular USB 3.0 receptacle connector includes a receptacle connector shell 901 and the shell 901 is surrounded by a receptacle connector tongue plate 902. A top surface of the receptacle connector tongue plate 902 includes four USB 2.0 receptacle connector terminals (VBUS, D+, D− and GND) able to compatible with USB 2.0. In addition, it also includes five USB 3.0 receptacle connector terminals 904 (SSRX+, SSRX−, GND_DRAIN, SSTX+, and SSTX−) able to connect to the USB 3.0 interface. The USB 3.0 receptacle connector terminals are disposed in a front end of the receptacle connector tongue plate 902 and the USB 2.0 receptacle connector terminals are disposed in a back end of the USB 3.0 receptacle connector terminals 904.

Thereafter, please refer to FIG. 1B, it is a view illustrating a USB plug connector in prior art. The USB 3.0 connector includes a USB 3.0 plug connector 90 and a USB 3.0 receptacle connector 92. As shown in FIG. 1B, the USB 3.0 plug connector 92 includes a plug connector shell 921 surrounded by a plug connector tongue plate 922. The top surface of the plug connector tongue plate 922 also includes four USB 2.0 plug connector terminals 923 (VBUS, D+, D− and GND) and five USB 3.0 plug connector terminal 924 (SSRX+, SSRX−, GND_DRAIN, SSTX+ and SSTX−). The different from the USB 3.0 plug connector 8 is that the USB 3.0 plug connector terminal 924 is disposed in a back end of the USB 2.0 plug connector terminal 923.

Now, please refer to FIG. 1C, it is a sectional view illustrating the connection between the USB receptacle connector and the USB plug connector in prior art. As shown in FIG. 1C, when the USB 3.0 plug connector 90 is connected to the USB 3.0 plug connector 92, the plug connector shell 92 is plugged into the receptacle connector shell 90 and a portion of the receptacle connector tongue plate 902 and the plug connector tongue plate 922 are overlapped without contacting to each other. The USB 2.0 receptacle connector terminal 903 is connected to the USB 2.0 plug connector terminal 923 and the USB 3.0 receptacle connector terminal 904 is connected and conducted to the USB 3.0 plug connector terminal 924 so as to transmit and receive signal.

Please refer to FIG. 1D, it is a top transparent view illustrating the conventional USB receptacle connector. The USB 2.0 receptacle connector terminals 903 in the conventional USB 3.0 receptacle connector are arranged in parallel and the USB 3.0 receptacle connector terminals 904 are also arranged in parallel on top and bottom respectively. The four USB 2.0 receptacle connector terminals 903 are arranged alternatively in the cavities between the five USB 3.0 receptacle connector terminals 904. In accordance to FIG. 1A and FIG. 1D, the four USB 2.0 receptacle connector terminals 903 and the five USB 3.0 receptacle terminals 904 are very close to each other, and it is easy to have crosstalk interference in D+/D−, SSTX+/SSTX− and SSRX+/SSRX− so as to affect the quality of the transmission. Similarly, the same problem is occurred in the USB 3.0 plug connector 92.

SUMMARY OF THE INVENTION

In order to solve the aforementioned problems, an object of the present invention is to a receptacle connector to reduce or avoid the crosstalk interference.

According to the object above, a receptacle connector comprising a tongue plate including a plurality of first terminal slots and a plurality of second terminal slots, a first terminal set with a plurality of terminals and each of the terminals includes a first contacting section, a first soldering section and a first connecting section for connecting the first contacting section and the first soldering section, the first terminal set disposed within the first terminal slots, a second terminal set with a plurality of terminals, each of the terminals includes a second contacting section, a second soldering section and a second connecting section for connecting the second contacting section and the second soldering section, wherein the receptacle connector is characterized in that the first terminal set comprises: a first pair of signal terminals disposed within two of the first terminal slots of the tongue plate to expose the first contacting section on the tongue plate; a power terminal disposed within one of the first terminal slots of the tongue plate to expose the first contacting section on the tongue plate; and a ground terminal disposed within one of the first terminal slots of the tongue plate to expose the first contacting section on the tongue plate; wherein the power terminal and the ground terminal are disposed at two sides of the first pair of the signal terminals; the second terminal set comprises: a second pair of signal terminals divided into a second internal signal terminal and a second external signal terminal, and the second pair of the signal terminals are disposed within the second terminal slots of the tongue plate at right side of the ground terminal to expose the second contacting section on the tongue plate; and a third pair of signal terminals divided into a third internal signal terminal and a third external signal terminal, and disposed within the second terminal slots of the tongue plate at left side of the ground terminal to expose the second contacting section on the tongue plate; wherein the second contacting section of the ground terminal widens at two sides and covers the two first contacting sections of the first pair of the signal terminals.

The receptacle connector provided in the present invention can widen the second connecting section of the ground terminal within the tongue plate to let the second pair of the signal terminals and the third pair of the signal terminals away from the first pair of the signal terminal to avoid the crosstalk interference caused by the first pair of the signal terminals in the second pair of the signal terminals and the third pair of the signal terminals to stabilize the transmission.

Another object of the present invention is to provide a plug connector to reduce the crosstalk interference.

According to object above, the present invention provides a plug connector comprising: a tongue plate including a plurality of first terminal slots and a plurality of second terminal slots, a first terminal set with a plurality of terminals and each of the terminals includes a first contacting section, a first extending section, a first soldering section and a first connecting section, the first terminal set disposed within the first terminal slots, a second terminal set with a plurality of terminals, each of the terminals includes a second contacting section, a second extending section, a second soldering section and a second connecting section, the second terminal set disposed within the second terminal slots, wherein the receptacle connector is characterized in that the first terminal set comprises: a first pair of signal terminals disposed within the two of the first terminal slots of the tongue plate to expose the first contacting section on the tongue plate; a power terminal disposed within the one of the first terminal slots of the tongue plate to expose the first contacting section on the tongue plate; and a ground terminal disposed within one of the first terminal slots of the tongue plate to expose the first contacting section on the tongue plate; wherein the power terminal and the ground terminal are disposed at two side of the first pair of the signal terminals; the second terminal set comprises: a ground terminal disposed within the one of the second terminal slots of the tongue plate to expose the second contact on the tongue plate; a second pair of signal terminals divided into a second internal signal terminal and a second external signal terminal, and the second pair of the signal terminals are disposed within two of the second terminal slots of the tongue plate at left side of the ground terminal to expose the second contacting section on the tongue plate; and a third pair of signal terminals divided into a third internal signal terminal and a third external signal terminal, and disposed within two of the second terminal slots of the tongue plate at right side of the ground terminal to expose the second contacting section on the tongue plate; wherein the second contacting section of the ground terminal widens at two sides and covers the two first contacting section of the first pair of the signal terminals.

According to the object above, the present invention provides a plug connector comprising: a tongue plate including a plurality of first terminal slots and a plurality of second terminal slots, a first terminal set with a plurality of terminals and each of the terminals includes a first contacting section, a first extending section, a first soldering section and a first connecting section, the first terminal set disposed within the first terminal slots, a second terminal set with a plurality of terminals, each of the terminals includes a second contacting section, a second extending section, a second soldering section and a second connecting section, the second terminal set disposed within the second terminal slots, wherein the receptacle connector is characterized in that the first terminal set comprises: a first pair of signal terminals disposed within two of the first terminal slots of the tongue plate to expose the first contacting section on the tongue plate; a power terminal disposed within one of the first terminal slots of the tongue plate to expose the first contacting section on the tongue plate; and a ground terminal disposed within one of the first terminal slots of the tongue plate to expose the first contacting section on the tongue plate; wherein the power terminal and the ground terminal are disposed at two side of the first pair of the signal terminals; the second terminal set comprises: a ground terminal disposed within one of the second terminal slots of the tongue plate to expose the second contact on the tongue plate; a second pair of signal terminals divided into a second internal signal terminal and a second external signal terminal, and the second pair of the signal terminals are disposed within two of the second terminal slots of the tongue plate at left side of the ground terminal to expose the second contacting section on the tongue plate; and a third pair of signal terminals divided into a third internal signal terminal and a third external signal terminal, and disposed within two of the second terminal slots of the tongue plate at right side of the ground terminal to expose the second contacting section on the tongue plate; wherein the second extending section of the ground terminal widens at two sides and covers the two first extending section of the first pair of the signal terminals.

The above-mentioned description of the present invention can be best understood by referring to the following detailed description of the preferred embodiments and the accompanying drawings.

DETAILED DESCRIPTION OF THE PREFERRED EMBODIMENTS

In the following detailed description of the preferred embodiments, reference is made to the accompanying drawings which form a part hereof; and as shown by way of illustration specific embodiments in which the invention may be practiced. In this regard, directional terminology, such as "top," "bottom," "front," "back," "left," "right," "inside," "outside," "side," etc., is used with reference to the orientation of the Figure(s) being described. As such, the directional terminology is used for purposes of illustration and is in no way limiting the present invention.

Figure 1A:
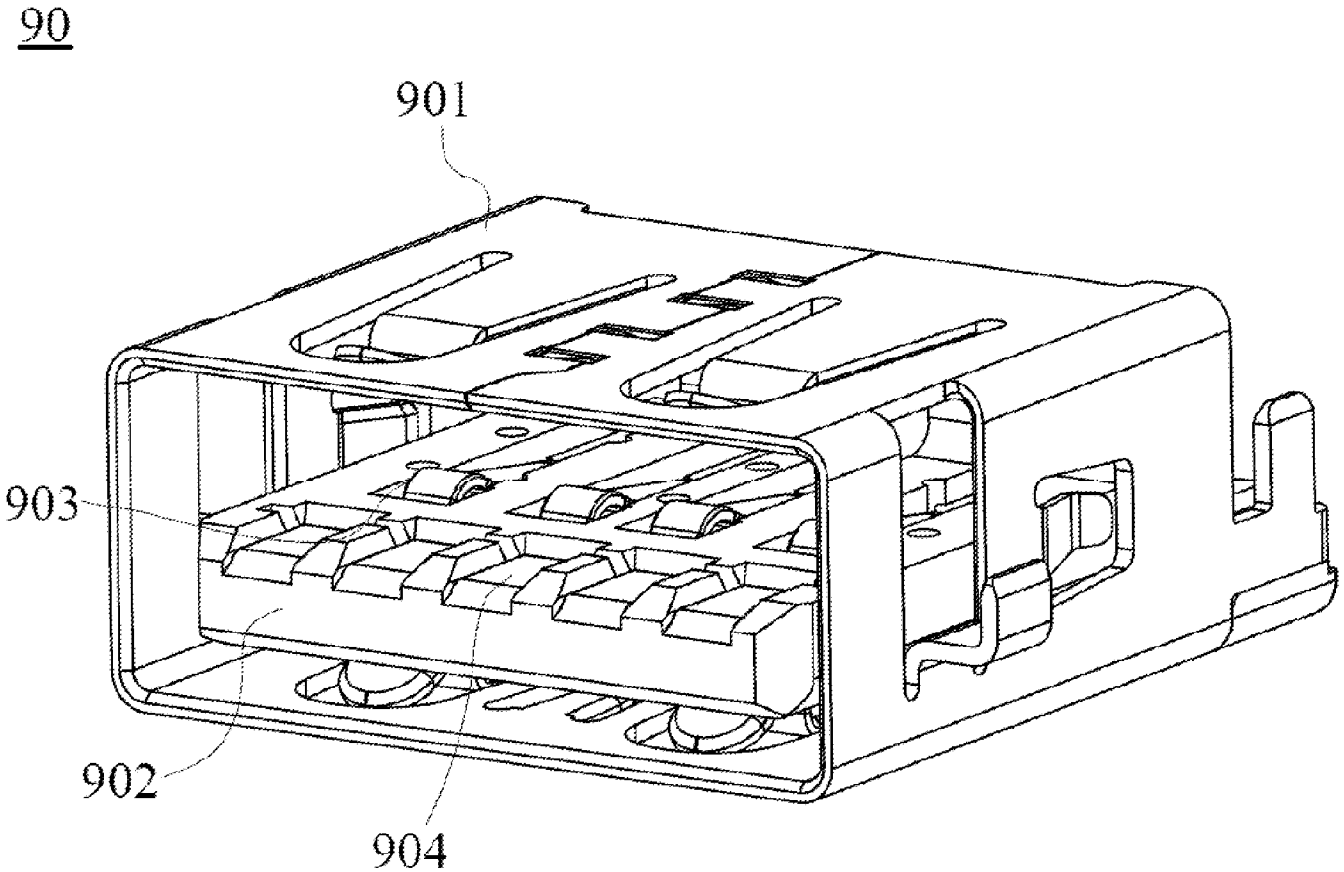
FIG. 1A (Prior Art)
FIG. 1A is a view illustrating a USB receptacle connector in prior art.
Figure 1B:
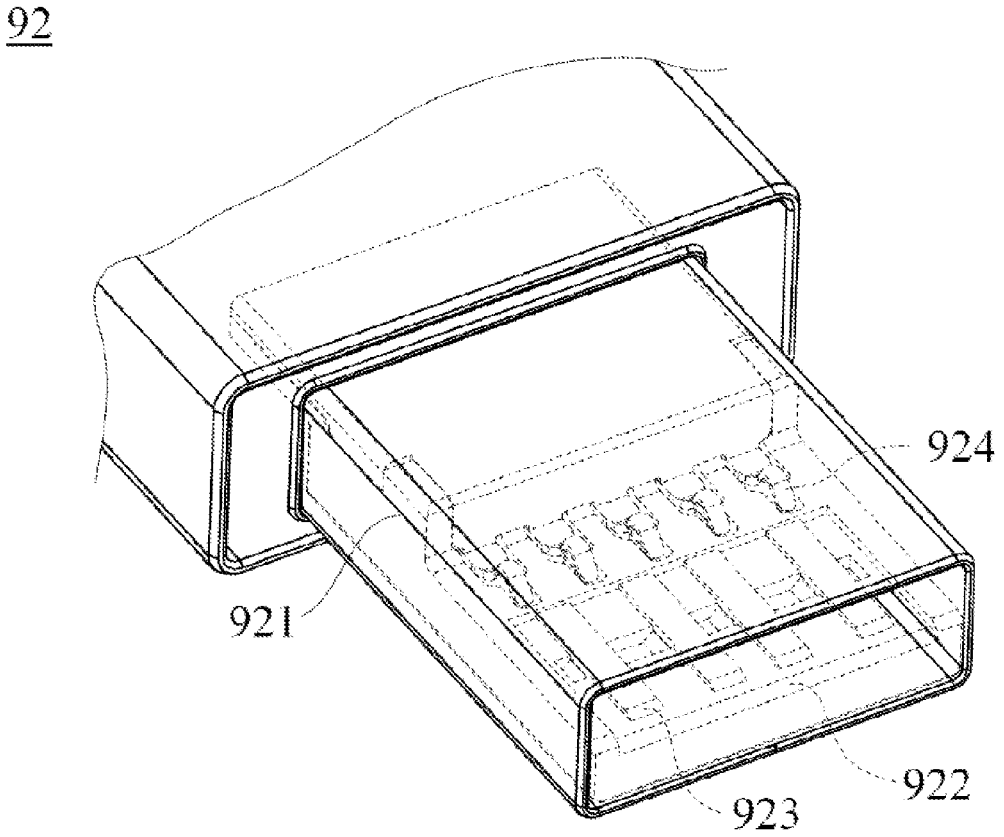
FIG. 1B (Prior Art)
FIG. 1B is a view illustrating a USB plug connector in prior art.
Figure 1C:
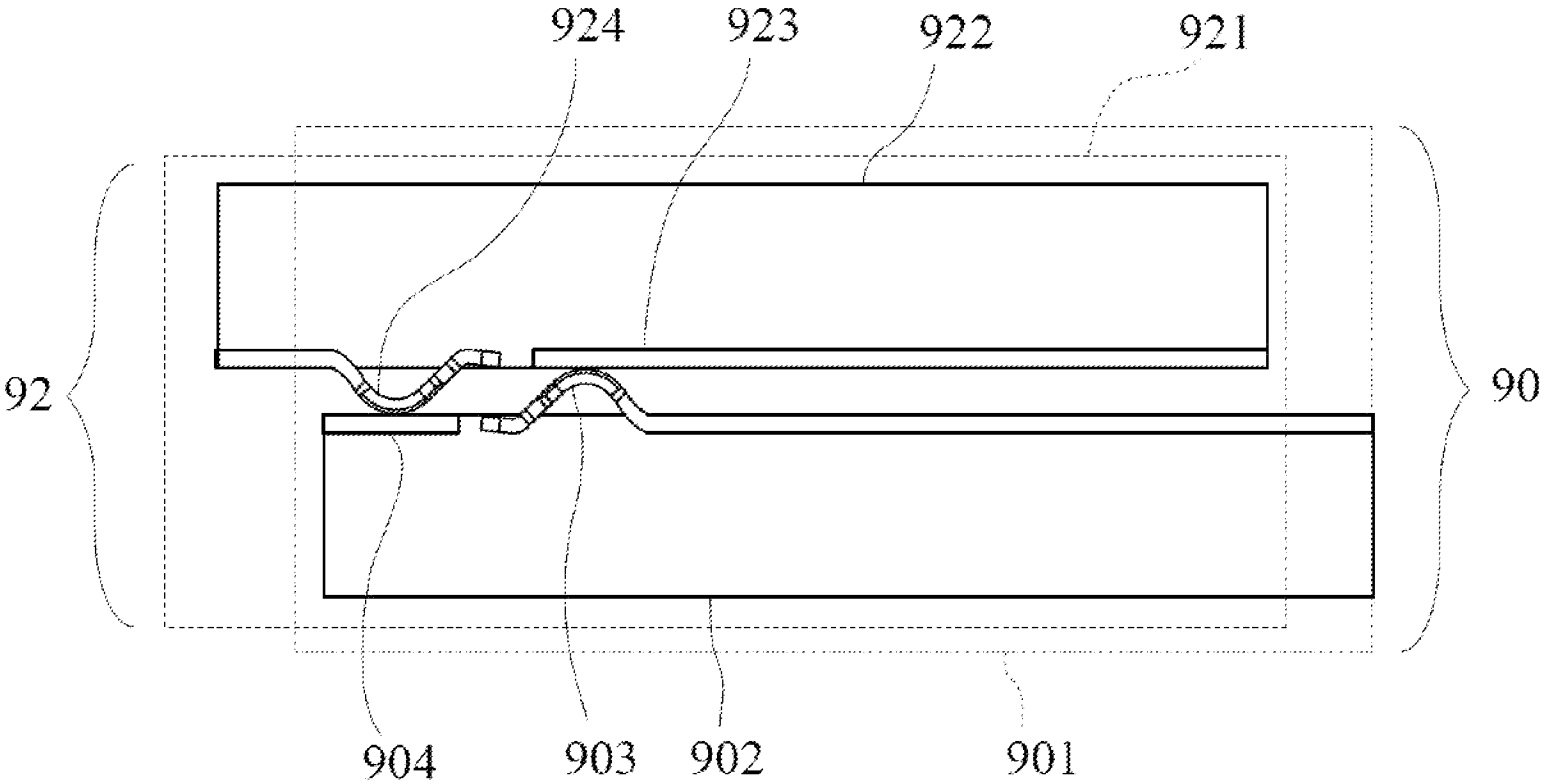
FIG. 1C (Prior Art)
FIG. 1C is a sectional view illustrating the connection between the USB receptacle connector and the USB plug connector in prior art.
Figure 1D:
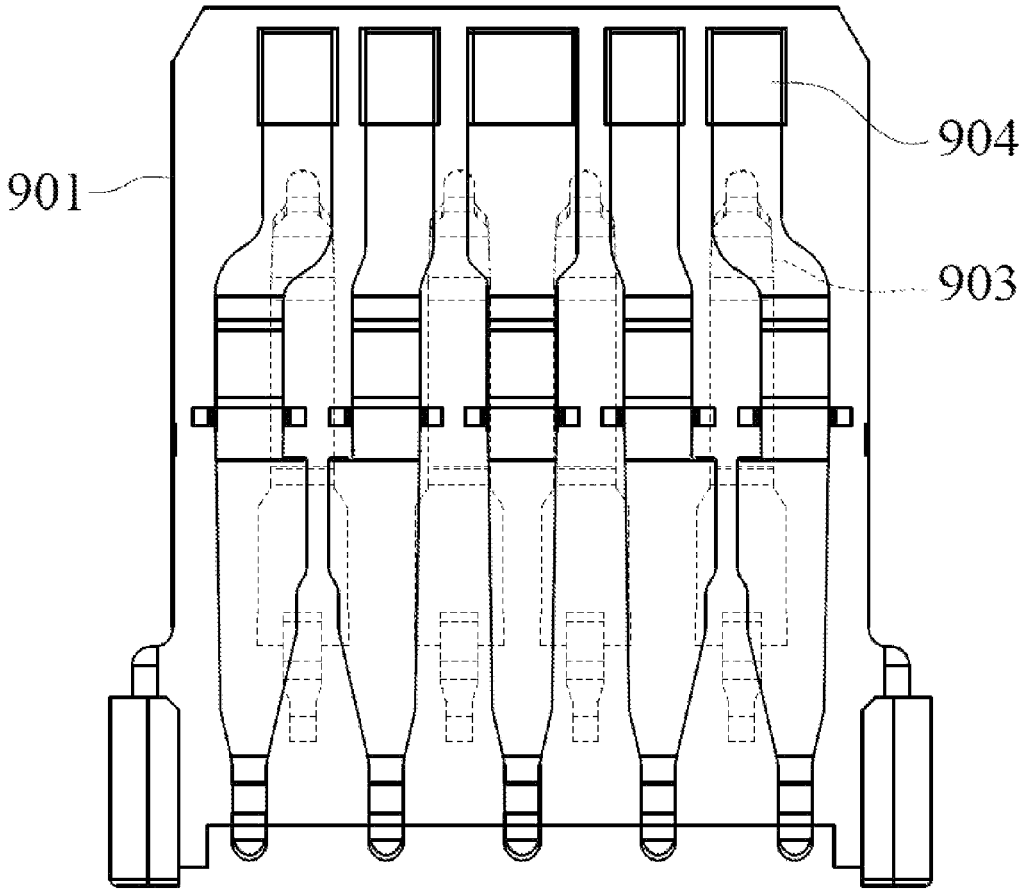
FIG. 1D (Prior Art)
FIG. 1D is a top transparent view illustrating the conventional USB receptacle connector
Figure 2:
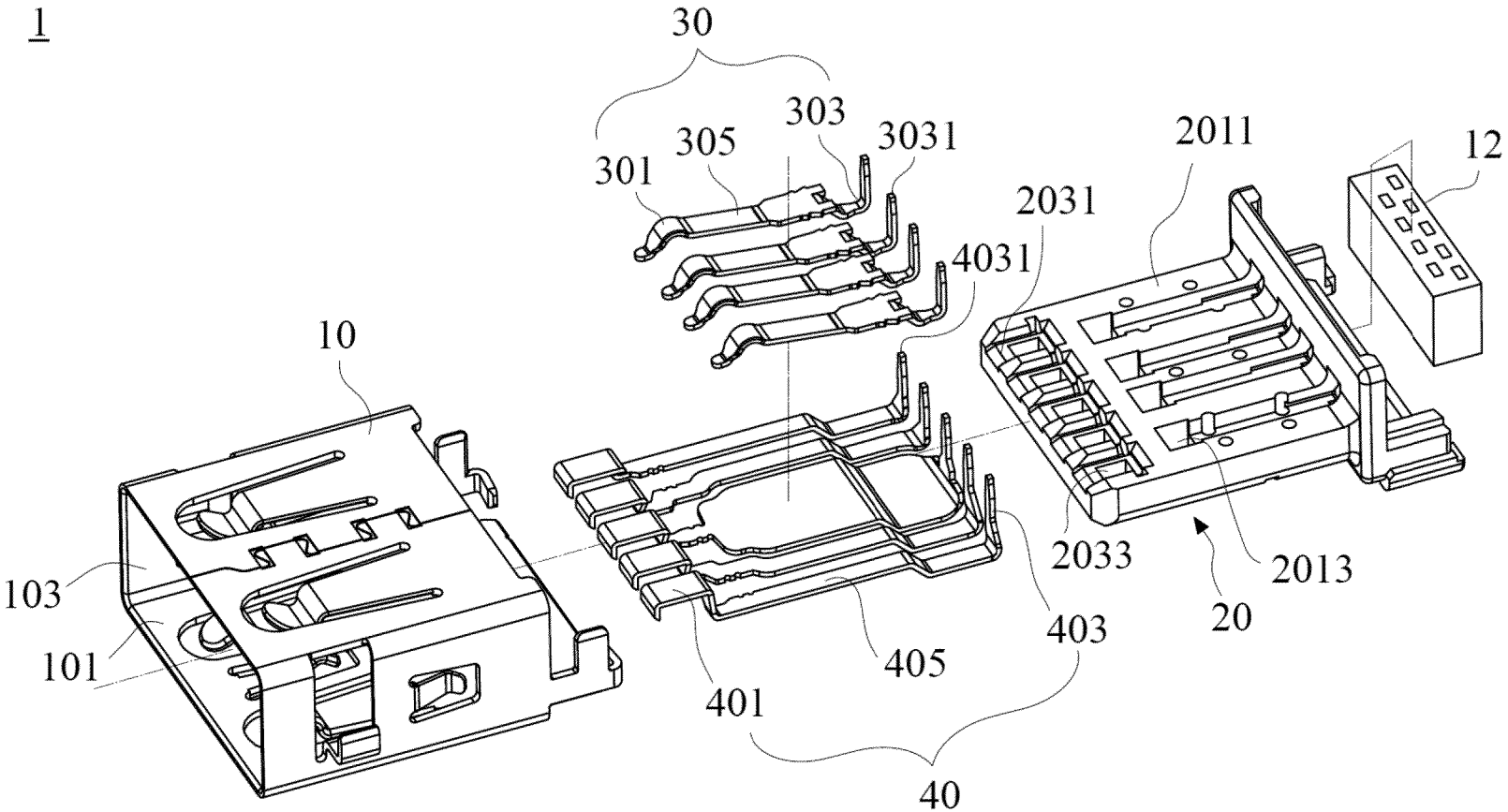
FIG. 2 is a exploded view illustrating the USB receptacle connector in the present invention.

Firstly, please refer to FIG. 2, it is an explored view illustrating a USB receptacle connector in the present invention. As shown in FIG. 2, the USB receptacle connector 1 includes: a tongue plate 20 and a top surface thereof consists of a first surface 2011 and a second surface 2031. A plurality of first terminal slots 2013 are formed on the first surface 2011 and a plurality of second terminal slots 2033 are formed on the second surface 2031. The first terminal set 30 consists of a plurality of terminals and each of the terminals includes a first contacting section 301, a first soldering section 303 and a first connecting section 305 for connecting the first contacting section 301 and the first soldering section 303. The first terminal set 30 is disposed within the first terminal slots 2013. The second terminal set 40 consists of a plurality of terminals and each of the terminals includes a second contacting section 401, a second soldering section 403 and a second connecting section 405 for connecting the second contacting section 401 and the second soldering section 403. The second terminal set 40 disposes within the second terminal slots 2033.

The second terminal set 40 exposes the second contacting section 401 when the second terminal set 40 is disposed within the second terminal slots 2033. The first soldering section 303 bends upward to form a first soldering pin 3031 and the second soldering section 403 bends upward to form a second soldering pin 4031. A shell body 10 includes an open end 101 and covers the tongue plate 20. The top and bottom walls 103 at the internal of the tongue plate 20 and the shell body 10 keeps an interval from each other. The first contacting section 301 and the second contacting section 401 are disposed near the open end 101. A rear organizer 12 covers the back end of the tongue plate 20 and includes a plurality of holes to contain the first soldering pin 3031 and the second soldering pin 4031 so as to make the first soldering pin 3031 and the second soldering pin 4031 protrude upward from the rear organizer 12. The first contacting section 301 is a protruding contact point and the second contacting section 401 is a flat contact point.

Figure 3A:
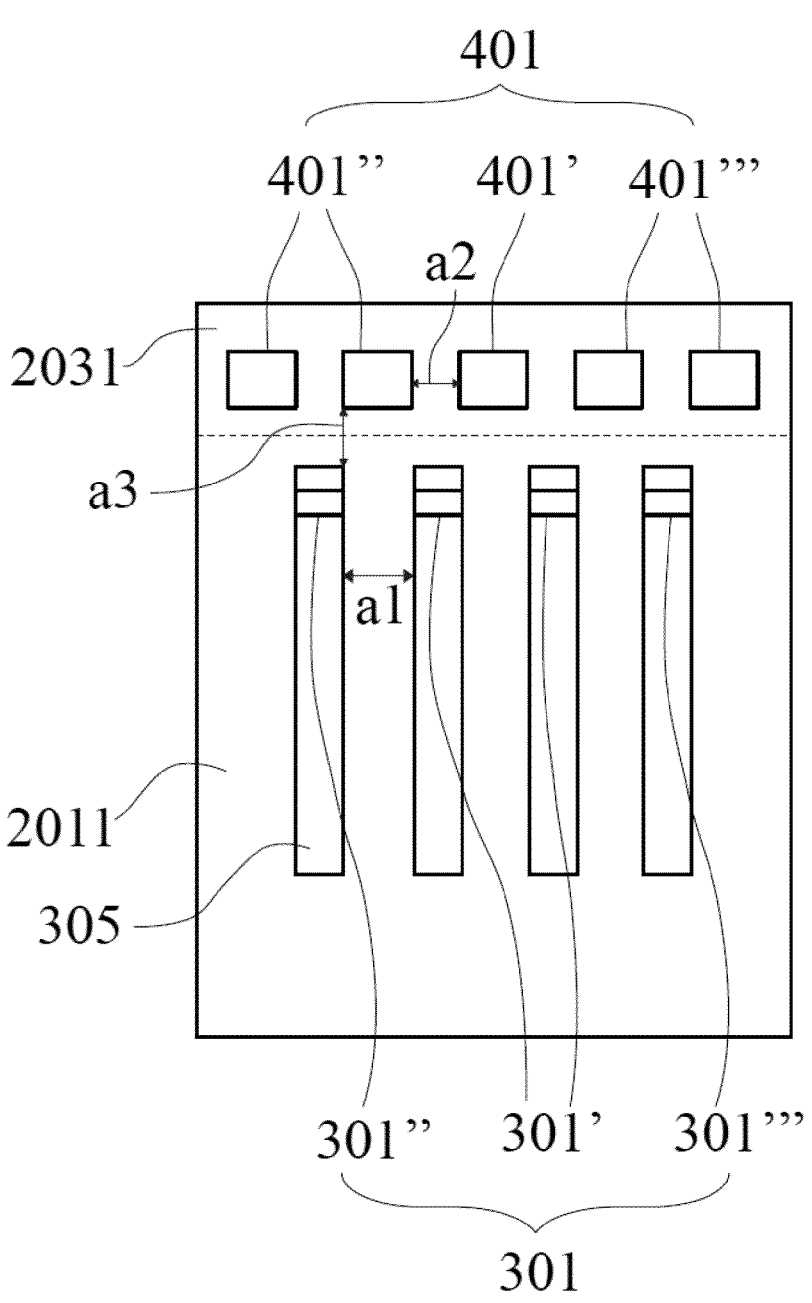
FIG. 3A and FIG. 3B are a top view and a sectional view of the tongue plate of the USB receptacle connector in the present invention.
Figure 3B:
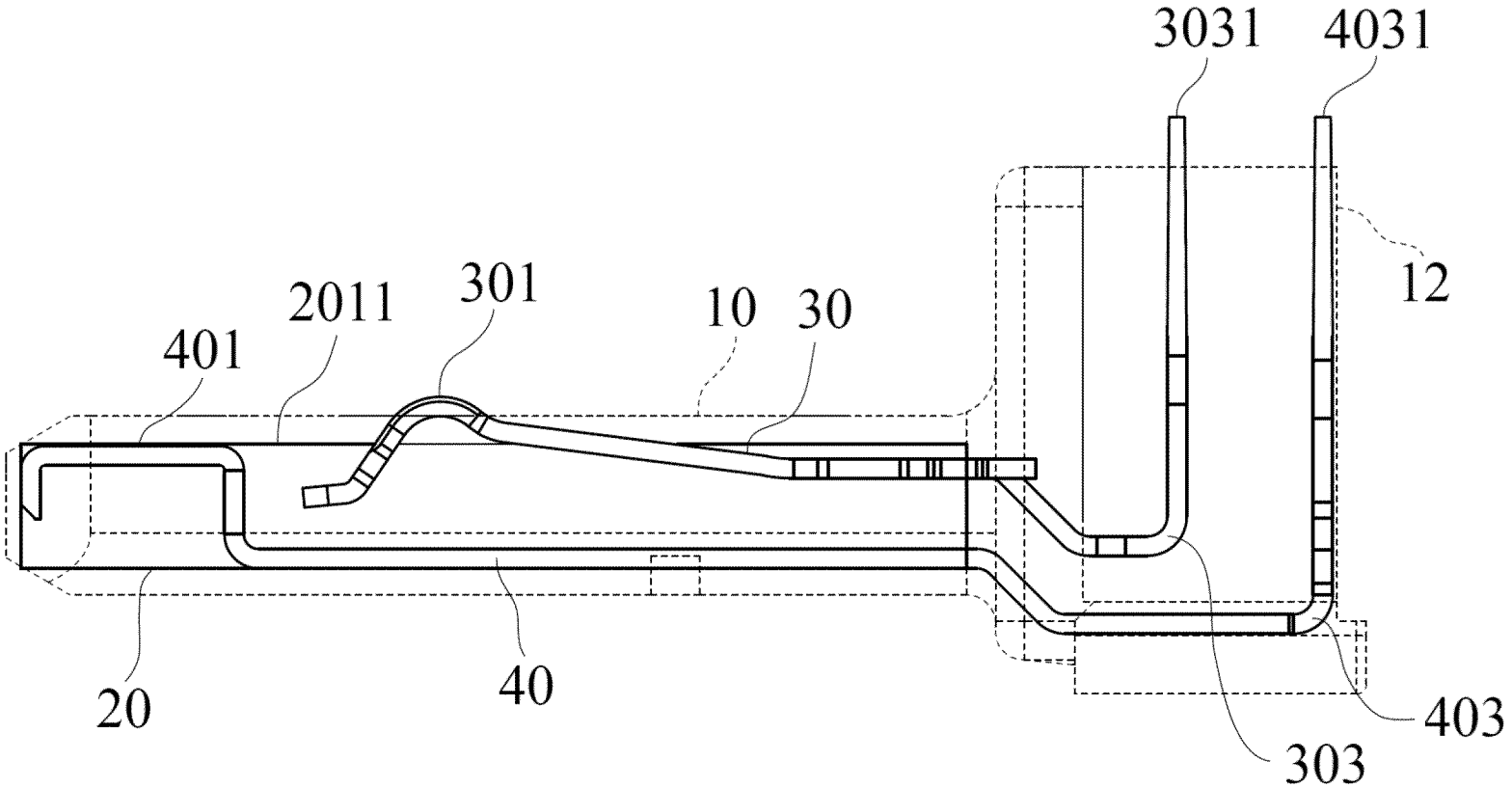

Now, please refer to FIG. 3A and FIG. 3B, which are a top view and a sectional view of the tongue plate of the USB receptacle connector in the present invention. As shown in FIG. 3A, a plurality of the first contacting sections 301 exposes on the first surface 2011 of the tongue plate 20. The first contacting sections 301 are arranged and separated in parallel with a first interval a1. A plurality of the second contacting sections 401 expose on the second surface 2031 of the tongue plate 20. The second contact contacting sections 401 are arranged and separated in parallel with a second interval a2. There is a third interval a3 between the first contacting sections 301 and the second contacting sections 401 to seperate the first contacting sections 301 from the second contacting sections 401.

In addition, each of the first contacting sections 301 is disposed above an interval formed between terminals of the second terminal set 40, especially between each the second contacting section 401 and each second connecting section 405, to avoid the first contacting sections 301 overlapping the second contacting sections 401 and the second connecting sections 405 of the second terminal so as to reduce and avoid the crosstalk interference caused by a first pair of signal terminals 32 in a second pair of signal terminals 44 and a third pair of signal terminals 46.

In addition, since the first terminal set 30 is close to the first surface 2011 of the tongue plate 20, the first connecting section 305 can also expose on the top surface 2011 of the top plate 201. In the present embodiment, the first contacting sections 301 are arranged in parallel with a first interval a1 therebetween to separate each first contacting section 301. The second contacting sections 401 are also arranged in parallel with a second interval a2 therebetween to separate each second contacting section 401. There is a third interval a3 between each first contacting section 301 and each second contacting section 401. It should be noted that the description above is an example and it is not to limit the present invention. In other words, the interval between the first contacting sections 301, between the second contacting sections 401 or between first contacting sections 301 and the second contacting sections 401 may not be the same.

Please refer to FIG. 3B, since the second terminal set 40 within the tongue plate 20 is disposed at the bottom of the first terminal set 30, the second contacting sections 401 bend upward to expose when the second contacting sections 401 of the second terminal set 40 are required to expose over the contacting surface 22 of a free end 201. Since the first terminal set 30 is on top, the second contacting sections 401 can expose on the first surface 2011 of the tongue plate 20 directly. The first soldering sections 303 of the first terminal set 30 and the second soldering sections 403 of the second terminal set 40 bend upward to be the first soldering pins 3031 and the second soldering pins 4031 for electrically connecting to external devices. The terminals in the first terminal set 30 and the second terminal set 40 are made integrally by copper integrated or installed with the tongue plate 20.

Figure 4:
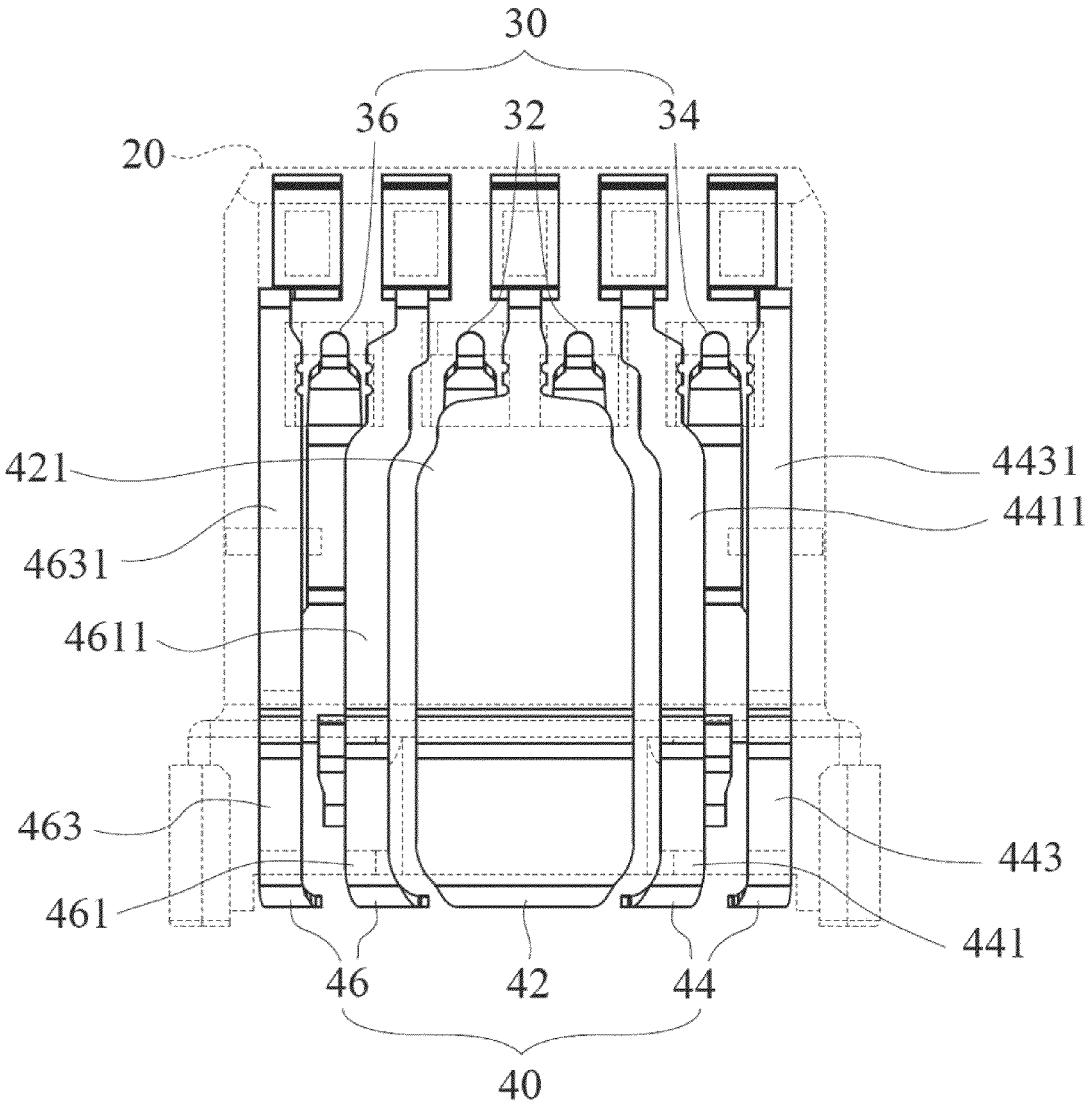
FIG. 4, it is a transparent top view of the first terminal set and the second terminal set of the USB receptacle connector in one embodiment of the present invention.

Please refer to FIG. 4, it is a transparent top view of the first terminal set and the second terminal set of the USB receptacle connector in one embodiment of the present invention. As shown in FIG. 4, the first terminal set 30 includes the first pair of signal terminals 32 arranged in parallel and disposed within two of the first terminal slots 2013 of the tongue plate 20 to expose the first contacting sections 301' (as shown in FIG. 3A) on the first surface 2011 of the tongue 20. The first pair of signal terminals 32 are half-duplex differential signal lines (D+/D−) for transmitting or receiving signal in one direction. A power terminal 34 is arranged in parallel to the first pair of signal terminals 32 and disposed within one of the first terminal slots 2013 of the tongue plate 20 to expose the first contacting section 301" (as shown in FIG. 3A) on the first surface 2011 of the tongue plate 20. In accordance with the top view, the power terminal 34 is disposed at right side of the first pair of signal terminals 32 to provide power. In accordance with the bottom view, the power terminal 34 is disposed at left side of the first pair of signal terminals 32. The ground terminal 36 is arranged in parallel to the first pair of the signal terminals 32 and disposed within one of the first terminal slots 2013 of the tongue plate 20 to expose the first contacting section 301''' (as shown in FIG. 3A) on the first surface 2011 of the tongue plate 20. In accordance with the bottom view, the ground terminal 36 is disposed at left side of the first pair of signal terminals 32 to provide a grounding path for electro static discharge so as to avoid the damage of the electronic devices because of the static electricity. In accordance with the top view, the ground terminal 36 is disposed at right side of the first pair of signal terminals. It should be noted that the first pair of signal terminals 32, the power terminal 34 and the ground terminal 36 in the first terminal set 30 are for providing USB 2.0 contact points.

Please still refer to FIG. 4, the second terminal set 40 includes a ground terminal 42 in parallel to the first terminal set 30 and disposed within one of the second terminal slots 2033 of the tongue plate 20 to expose the second contacting sections 401'''(as shown in FIG. 3A) on the second surface 2031 of the tongue plate 20. The ground terminal 42 is used to provide a reference voltage level and to provide a standard voltage level for the whole circuit. A second pair of signal terminals 44 are parallel to the first terminal set 30 and disposed within two of the second terminal slots 2033 of the tongue plate 20. In accordance with the bottom view, the second pair of signal terminals 44 are disposed at right side of the ground terminal 42 to expose the second contacting section 401" (as shown in FIG. 3A) on the second surface 2031 of the tongue plate 20. The second pair of signal terminals 44 are simplex differential action signal lines (SSTX+/SSTX−) to transmit signal in one direction. A third pair of signal terminals 46 are arranged in parallel to the first terminal set 30 and disposed within two of the second terminal slots 2033 of the tongue plate 20. In accordance with the bottom view, the third pair of signal terminals 46 are disposed at left side of the ground terminal 42 to expose the second contacting sections 401''' (as shown in FIG. 3A) on the second surface 2031 of the tongue plate 20. The third pair of signal terminals 46 are simplex differential signal line (SSRX+/SSRX−) to receive signal in one direction. It should be noted that the ground terminal 42, the second pair of signal terminals 44 and the third pair of signal terminals 46 in the second terminal set 40 are used for providing the USB 3.0 contact points and each terminal thereof is consisted of the second contacting section 401, the second connecting section 405 and the second soldering section 403.

The width of the connecting section 421 of the ground terminal 42 is greater than the width of the first pair of signal terminals 32. As shown in the bottom view in FIG. 4, the width of the connecting section 421 (i.e. the second contacting section 405) of the ground terminal 42 is greater than the width of the first pair of signal terminals 32 and a portion thereof covers the first pair of signal terminals 32. The connecting section 421 in the of the ground terminal 42 in present invention covers a portion of the first connecting section 305 (as shown in FIG. 2)of the first pair of signal terminals 32 to expose a portion of the first contacting sections 301. The second pair of signal terminals 44 are divided into a second internal signal terminal 441 and a second external signal terminal 443. The third pair of the signal terminals 46 are divided into a third internal signal terminal 461 and a third external signal terminal 463.

Since the width of the ground terminal 42 within the tongue plate 20 is increased, it is necessary to extend the shape of the second pair of signal terminals 44. The second internal connecting section 4411 (i.e. the second connecting section 405) of the second internal signal terminal 441 bends and surrounds at right side of the connecting section 421 of the ground terminal 42 so as to form an interval to avoid overlapping therebetween. The second external connecting section 4431 of the second external connecting section 443 is a straight line shape and shift to right side in parallel to the second internal connecting section 4411. Similarly, the third internal connecting section 4611 (i.e. the second connecting section 405) of the third internal signal terminal 461 at left side of the ground terminal 42 bends to one side and surrounds at left side of the connecting section 421 of the ground terminal 42 to form an interval to avoid overlapping therebetween. The third external connecting section 4631 of the third external signal terminal 463 is a straight line shape and shift to left side in parallel to the third internal connecting section 4611. The connecting section 421 within the tongue plate 20 is widened to make the second pair of signal terminals 44 and the third pair of signal terminal 46 bend to one side and surround the connecting section 421 so as to avoid the crosstalk interference caused by the first pair of signal terminals 32 in the second pair of signal terminals 44 and the third pair of signal terminals 46.

Figure 5:
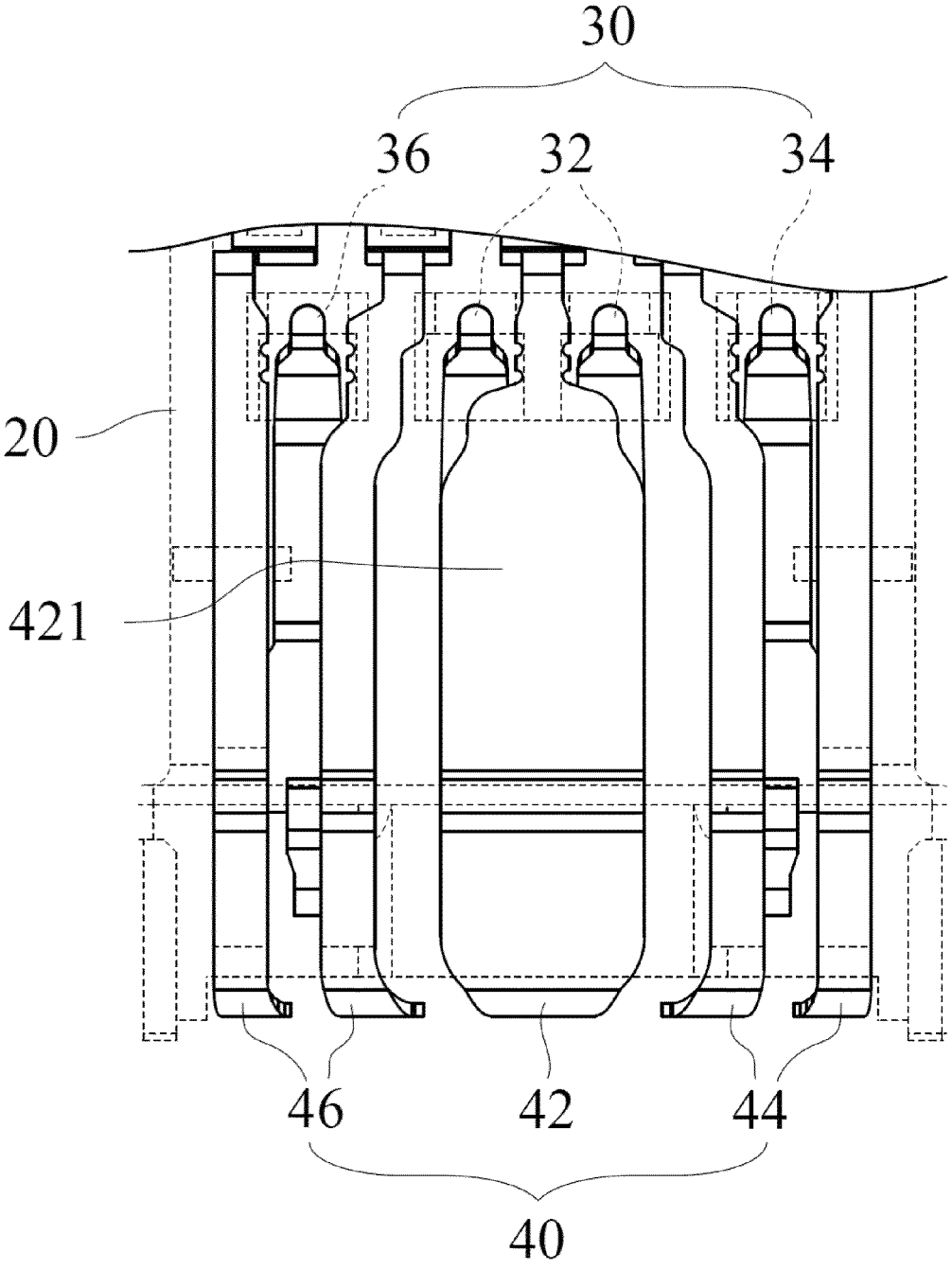
FIG. 5 is a transparent bottom view of the first terminal set and the second terminal set of the USB receptacle connector in second embodiment of the present invention.

Now, please refer to FIG. 5, it is a transparent bottom view of the first terminal set and the second terminal set of the USB receptacle connector in second embodiment of the present invention. As shown in FIG. 5, the different of the second embodiment from the first embodiment is that the connecting section 421 of ground terminal 42 is the same as the width of the first pair of signal terminals 32. The rest of the components in the second embodiment are the same as thereof in the first embodiment and the description thereof is omitted herein. The function is similar to avoid the crosstalk interference caused by the first pair of signal terminals 32 in the second pair of signal terminals 44 and the third pair of signal terminals 46.

Figure 6A:
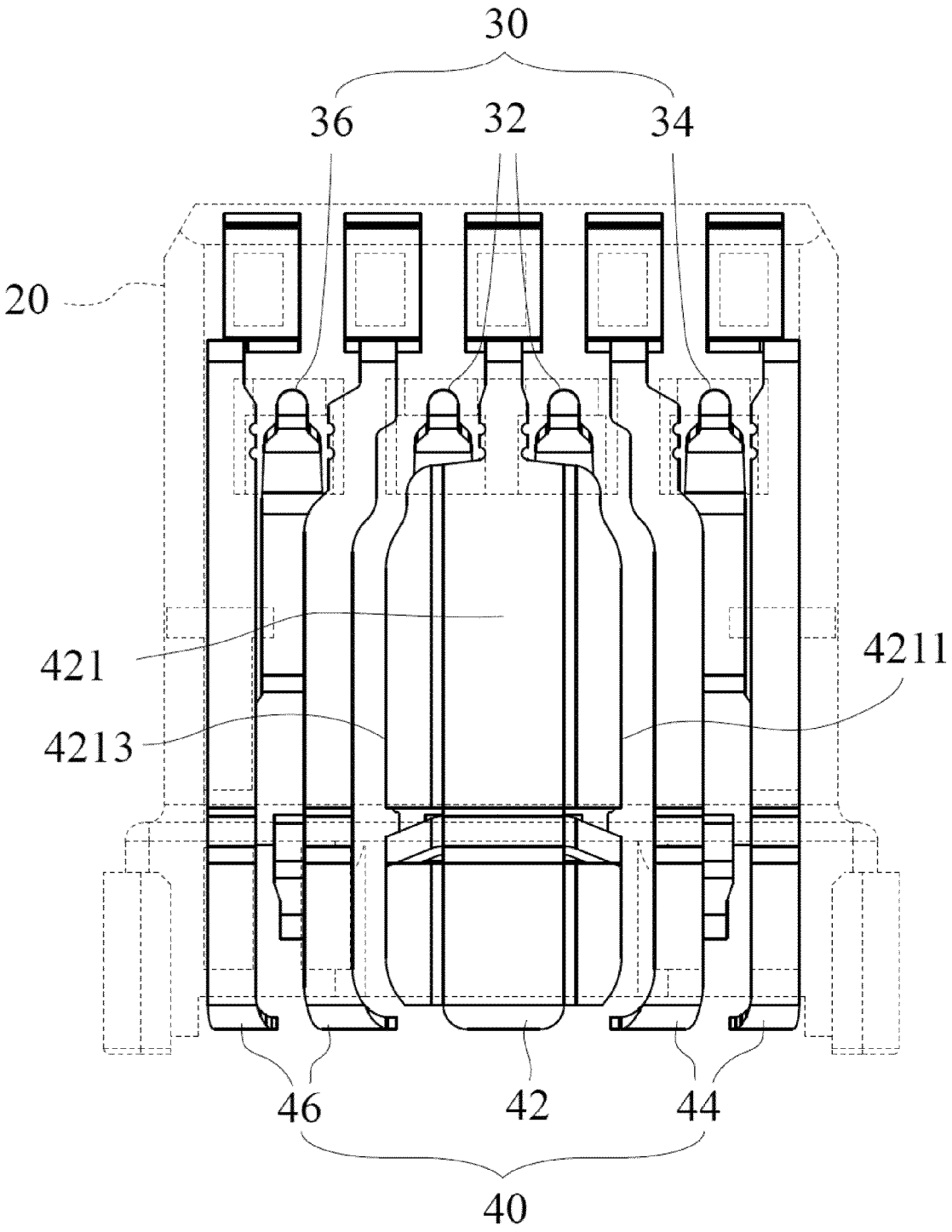
FIGS. 6A and 6B are a transparent bottom view and a plan view of the first terminal set and the second terminal set of the USB receptacle connector in third embodiment of the present invention.
Figure 6B:
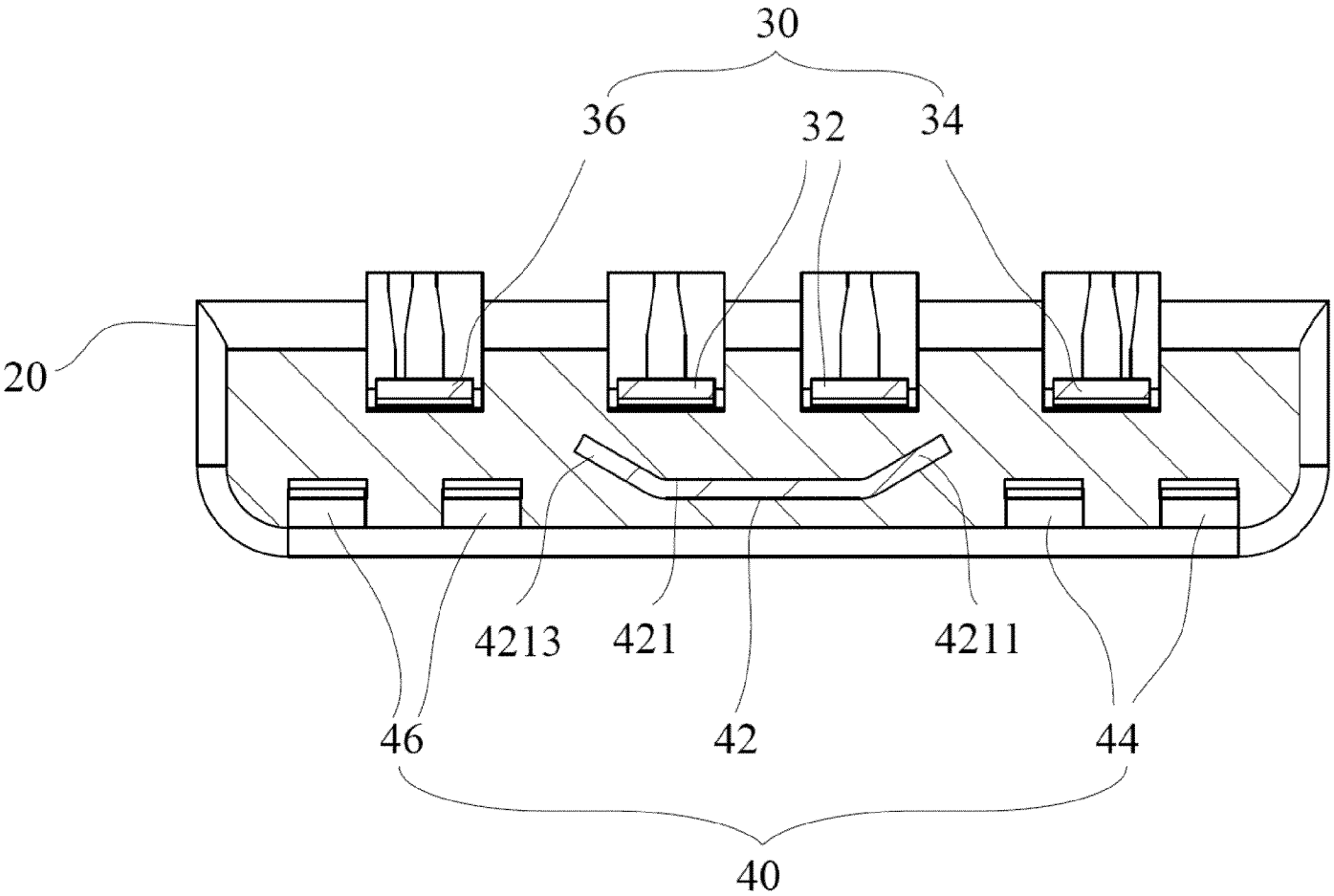

Now, please refer to FIGS. 6A and 6B, which are a transparent bottom view and a plan view of the first terminal set and the second terminal set of the USB receptacle connector in third embodiment of the present invention. As shown in FIG. 6A, the different of the third embodiment from the first embodiment is that the connecting section 421 within the tongue plate 20 partially covers the first pair of the signal terminals 32. The two covered side walls 4211 and 4213 of the connecting section 421 bend toward the direction of the first pair of the signal terminals 32.

As shown the sectional view in FIG. 6B, the two side walls 4211 and 4213 of the connecting section 421 bend toward the direction of the first pair of the signal terminal 32 and covers an area in the first pair of the signal terminals 32 to avoid the crosstalk interference caused by the first pair of the signal terminals 32 in the second pair of the signal terminals 44 and the third pair of the signal terminals 46. The rest of the components in the third embodiment are the same as thereof in the first embodiment and the description thereof is omitted herein.

Figure 7A:
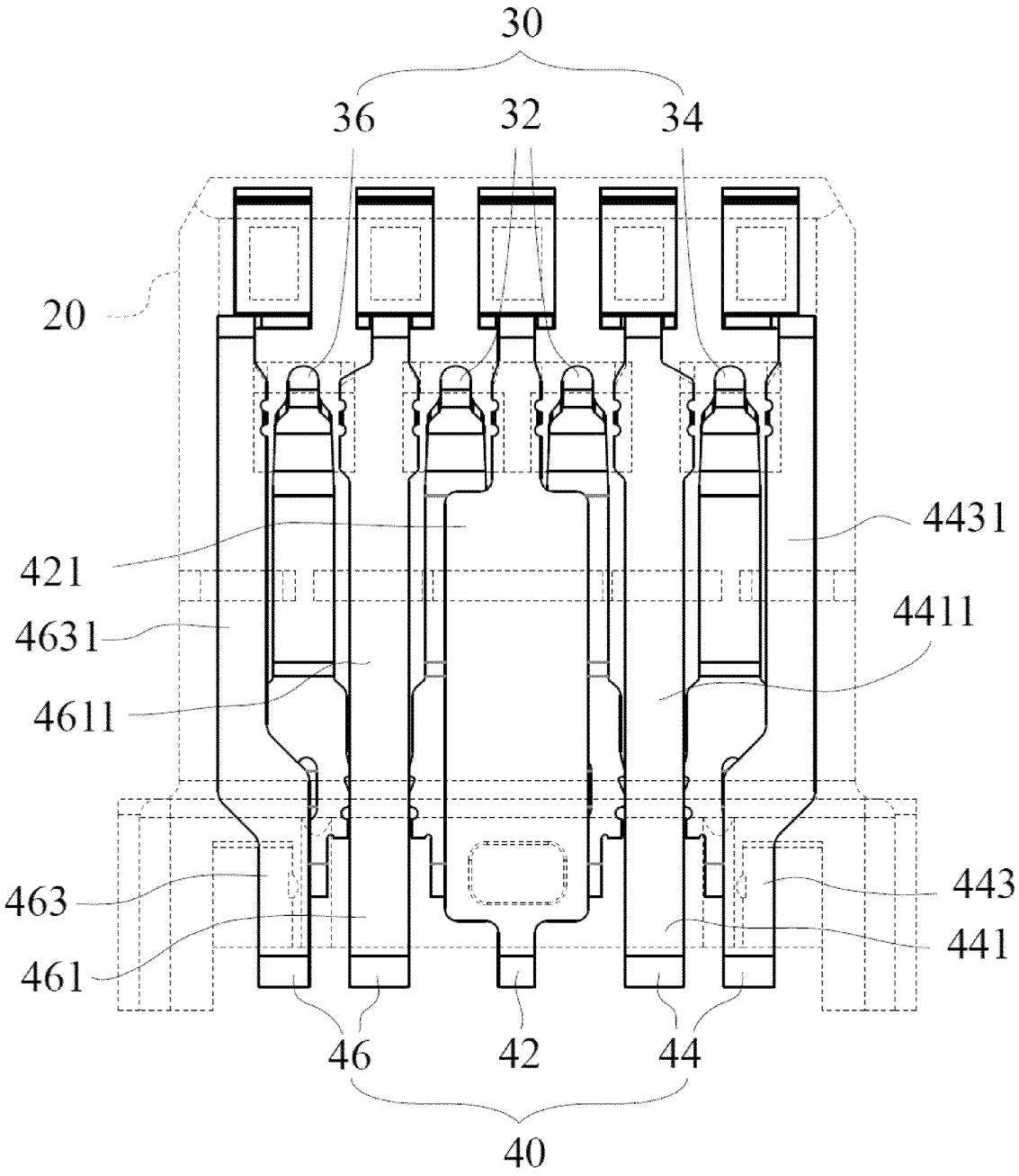
FIG. 7A is a transparent top view of the first terminal set and the second terminal set of the USB receptacle connector in a fourth embodiment of the present invention.

Please refer to FIG. 7A, it is a transparent top view of the first terminal set and the second terminal set of the USB receptacle connector in a fourth embodiment of the present invention. As shown in FIG. 7A, a portion of the connecting section 421 (i.e. the second connecting section 405 of the ground terminal 42) of the ground terminal 42 in the fourth embodiment widens to cover a portion of the first pair of the signal terminal 32 and the width thereof is less than the width of the first pair of the signal terminal 32. The second internal signal terminal 441 and the third internal signal terminal 461 are straight line shape and parallel to the ground terminal 42. A portion of the second external section 4431 of the second external signal terminal 443 and the third external connecting section 4631 of the third external signal terminal 463 shift to one side and parallel to the second internal signal terminal 441 and the third internal signal terminal 461. By widening the connecting section 421, it is to reduce or avoid the crosstalk interference in the second pair of the signal terminal 44 and the third pair of the signal terminal 46 caused by the first pair signal terminal 32.

Figure 7B:
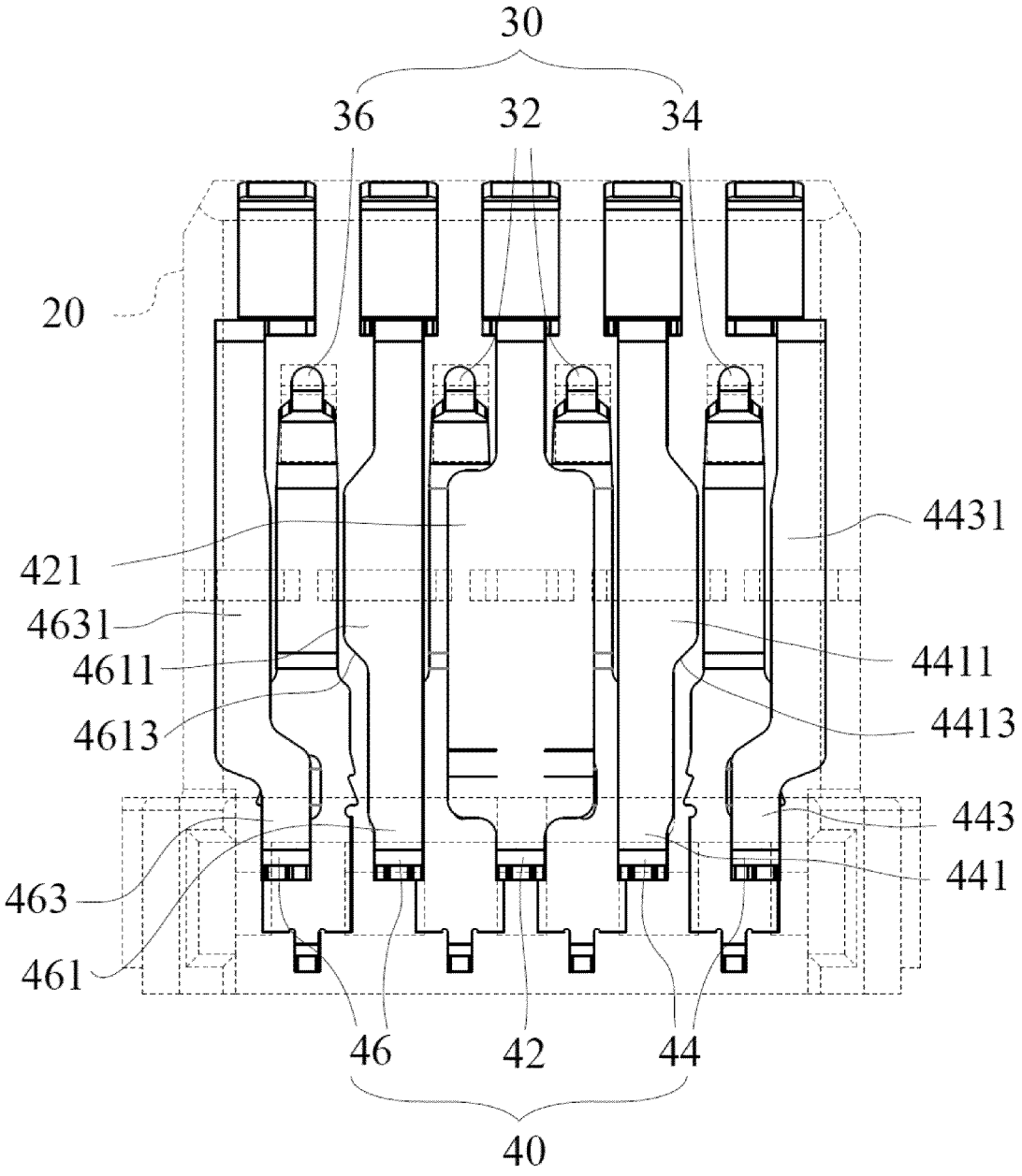
FIG. 7B is a transparent bottom view illustrating the first terminal set and the second terminal set of the USB receptacle connector in a fifth embodiment of the present invention.

Please refer to FIG. 7B, it is a transparent bottom view illustrating the first terminal set and the second terminal set of the USB receptacle connector in a fifth embodiment of the present invention. As shown in FIG. 7B, the difference of the fifth embodiment from the fourth embodiment is that there is an alar section 4413 extending to the second external signal terminal 443 in the second internal connecting section 4411 of the second internal signal terminal 441 and away from the second external signal terminal 443 with an interval. And an alar section 4613 extends to the third external signal terminal 463 in the third internal connecting section 4611 of the third internal signal terminal 461 and is away from the third external signal terminal 463 with an interval. The rest of the components in the fifth embodiment are the same as thereof in the fourth embodiment and the description is omitted herein. The function thereof is the same as to avoid the crosstalk interference caused by the first pair of the signal terminals 32 in the second pair of the signal terminals 44 and the third pair of the signal terminals 46.

Figure 8A:
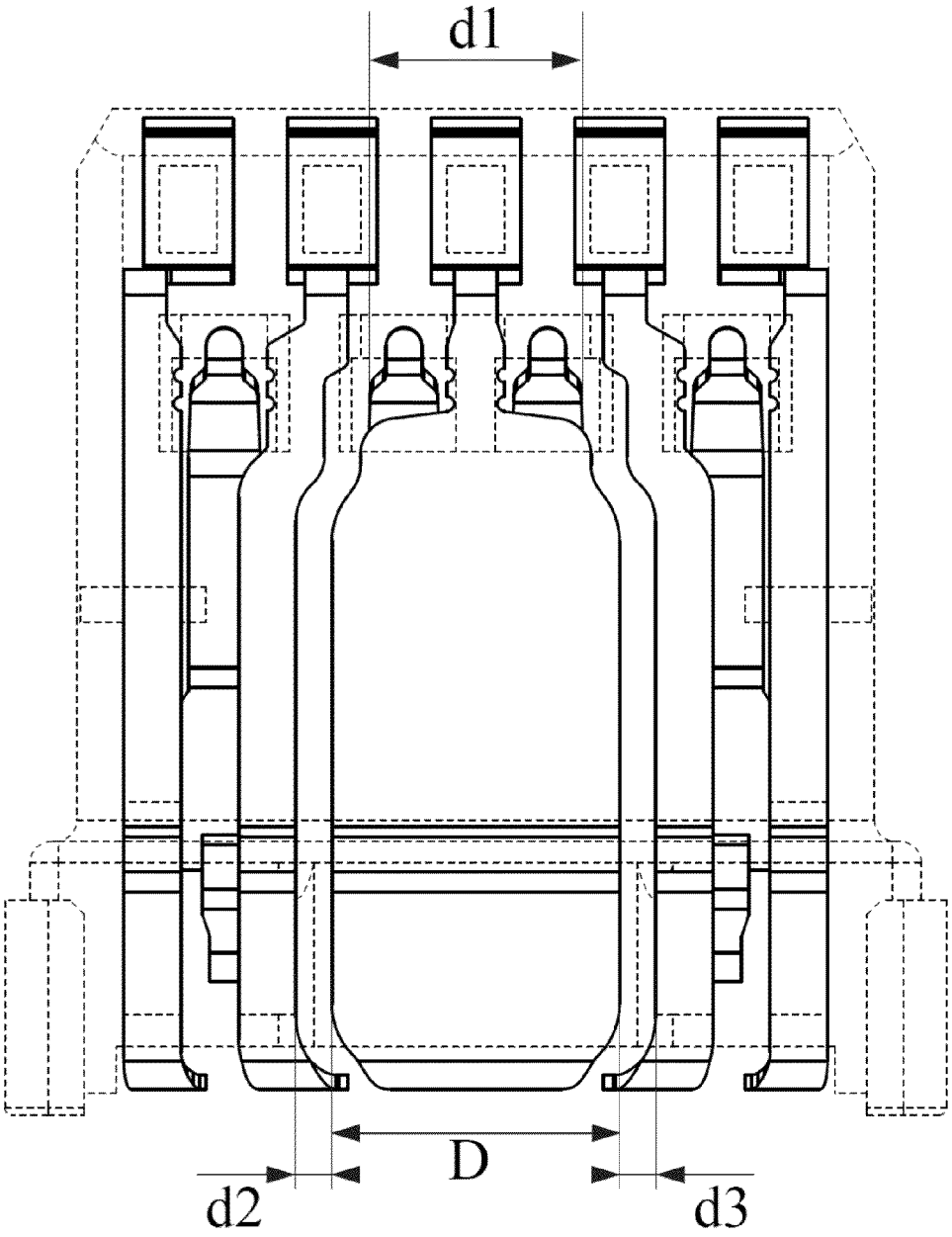
FIG. 8A and FIG. 8B are comparison views between the first terminal set and the second terminal sec of the USB receptacle connector in the present invention.
Figure 8B:
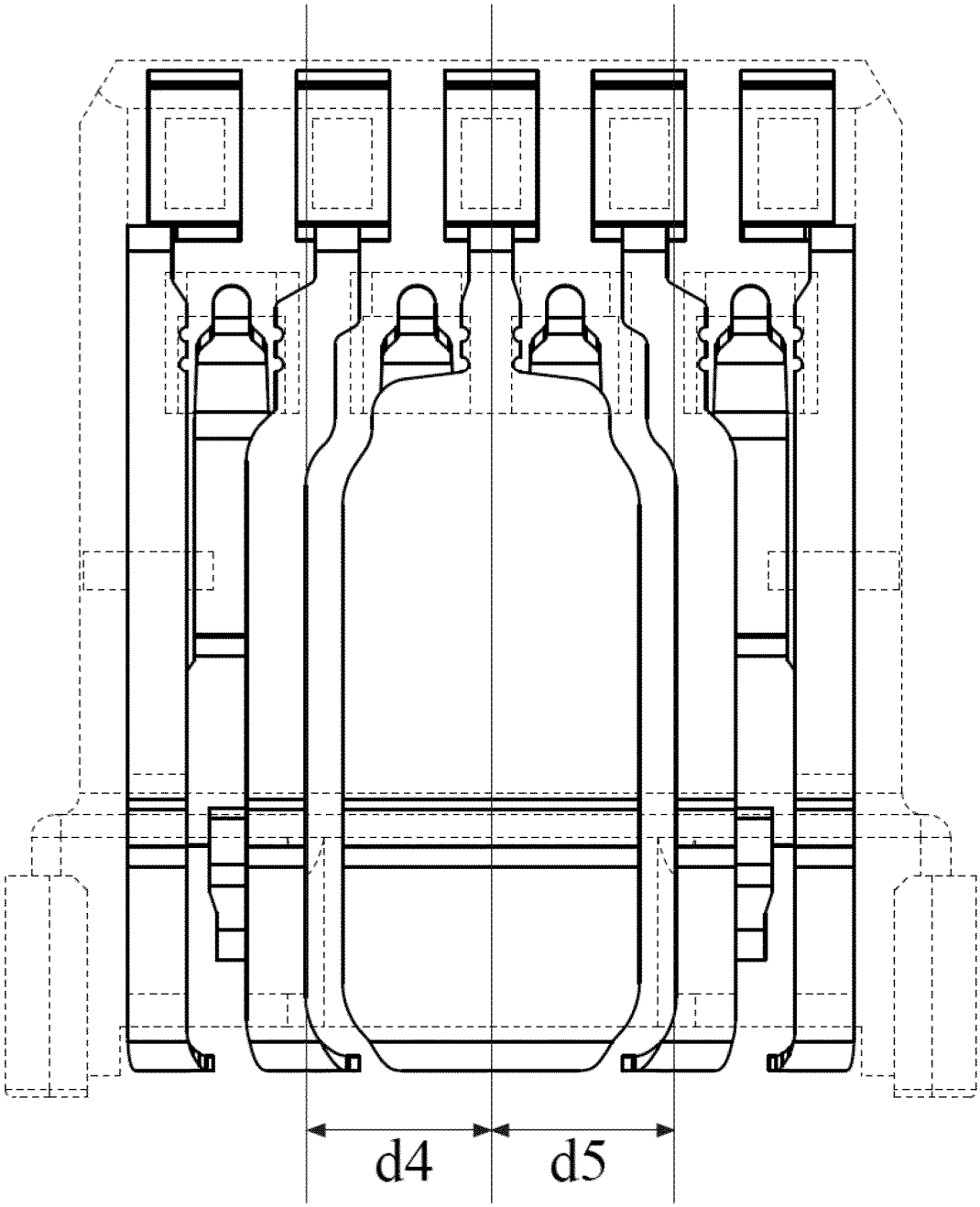

Please refer to FIG. 8A and FIG. 8B, which are comparison views between the first terminal set and the second terminal set of the USB receptacle connector in the present invention. As shown in FIG. 8A and FIG. 1, the width of the connecting section 421 in the present invention is D, and the width of the first pair of the signal terminals 32 is d1. According to figures, D is greater than d1. In addition, the interval between the side wall 4211 of connecting section 421 and the second pair of signal terminal 44 is d3, and the interval between side wall 4213 of the connecting section 421 and the third pair of signal terminals 46 is d2, and the width of d2 and d3 are greater than 0.4 mm.

In accordance with the first, second, third, fourth and fifth embodiments of the USB receptacle connector in the present invention, the width of the connecting section 421 within the tongue plate 20 of the USB receptacle connector 1 is greater than the width of the first pair of the signal terminals 32 to fully or partially cover the connecting sections of the first pair of the signal terminals 32 to avoid the crosstalk interference caused by the first pair of the signal terminals 32 in the second pair of the signal terminals 44 and the third pair of the signal terminals 46 so as to stabilize the transmission.

Figure 9:
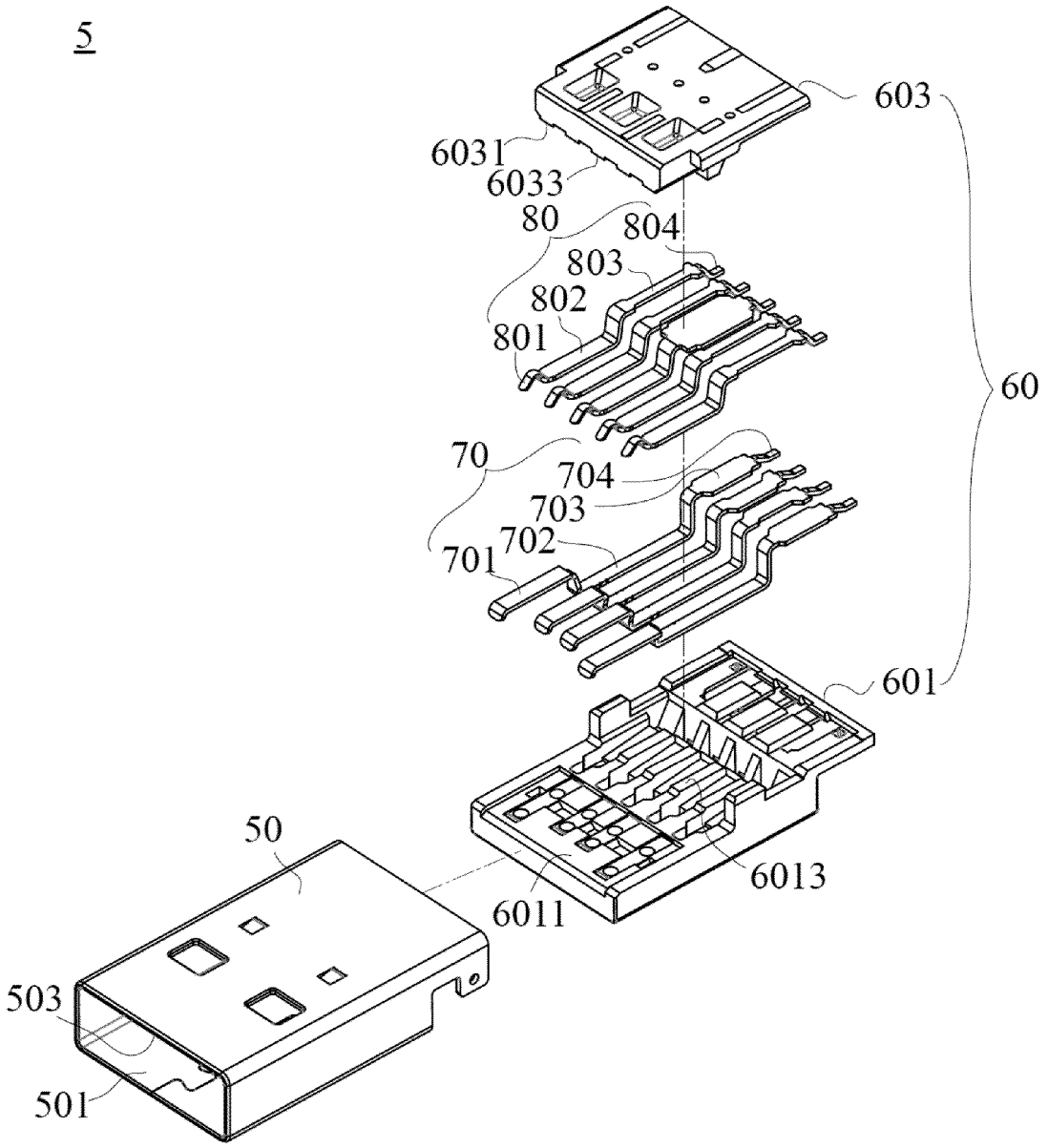
FIG. 9 is an explored view illustrating the USB plug connector in the present invention.

It is necessary to have a corresponding USB plug connector 5 for the USB receptacle connector 1. Please refer to FIG. 9, it is an explored view illustrating the USB plug connector in the present invention. The USB plug connector 5 includes a tongue plate 60, a first terminal set 70, and a second terminal set 80. The tongue plate 60 includes a bottom plate 601 and a top plate 603. The top surface 6011 of the bottom plate 601 includes a plurality of first terminal slots 6013 and the bottom surface 6031 of the top plate 603 includes a plurality of second terminal slots 6033. Each of the terminals in the first terminal set 70 includes a first contacting section 701, a first extending section 702, a first connecting section 703, and a first soldering section 704. The first terminal set 70 is disposed within the first terminal slots 6013 and the first soldering sections 704 extend from the rear ends of the first terminal slots 6013. Each of the terminals in the second terminal set 80 includes a second contacting section 801, a second extending section 802, a second connecting section 803 and a second soldering 804. The second terminal set 80 is disposed within the second terminal slots 6033 and the second contacting sections 801 and the second soldering contacting sections 804 extend from the front ends and the rear ends of the second terminal slots 6033.

When the bottom plate 601 covers the top surface 6031 of the top plate 603, the first contacting sections 701 and the second contacting sections 802 are exposed. A shell body 50 includes an open end 501 and covers the tongue plate 60 and the terminal side of the first contacting sections 701 and the second contacting sections 801 keep an interval from the side wall 503 of the shell body 50 and disposed at the open end 501. The first contacting sections 701 are plane contact points and the second contacting sections 801 are arch shape protruding contact points. Although the tongue 60 in the present invention is made by overlapping the bottom plate 601 and the top plate 603, it is not limited herein. The tongue plate 60 can be an integrated structure instead of the structure overlapped by the bottom plate 601 and the top plate 603.

Figure 10:
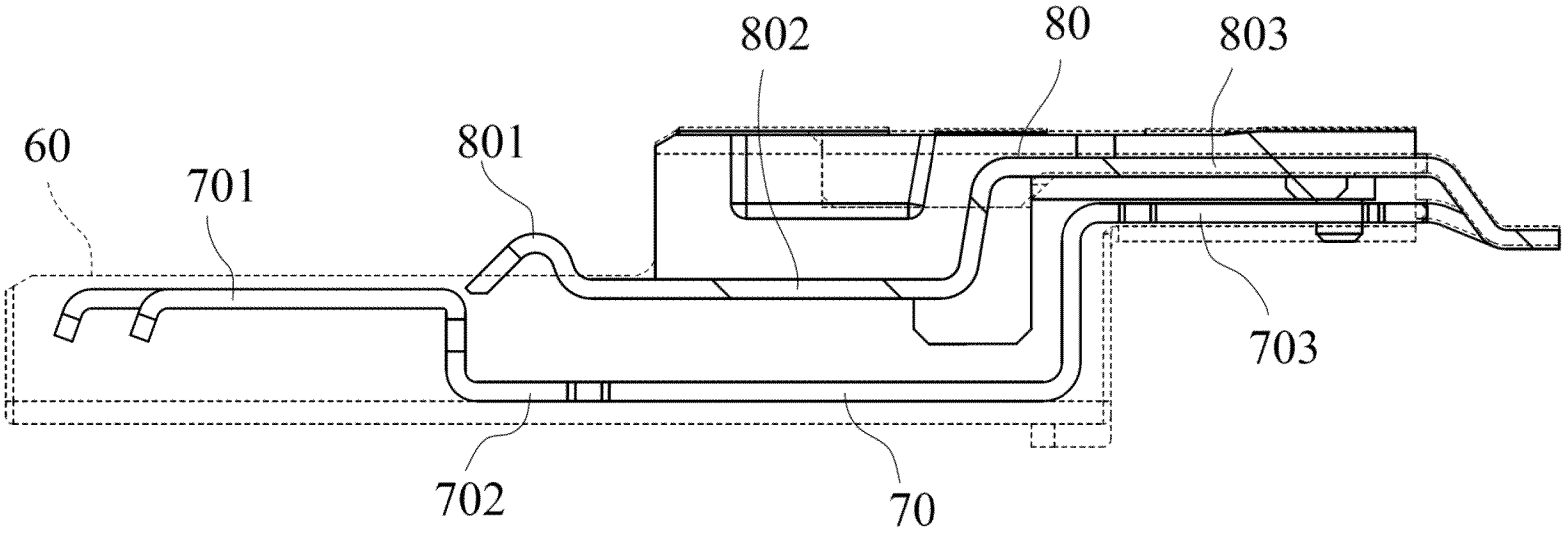
FIG. 10 is a section side view of the tongue plate of the USB plug connector in the present invention.

Now, please refer to FIG. 10, it is a section side view of the tongue plate of the USB plug connector in the present invention. As shown in FIG. 10, when the first terminal set 70 and the second terminal set 80 are disposed in the tongue plate 60, the first terminal set 70 is under the second terminal set 80. Each first contacting section 701 of the first terminal set 70 extends and bends toward one end of the first extend section 702, and a height difference formed between the first extend section 702 and the first contacting section 701. The first connecting section 703 extends and bends toward another end of the first extend section 702, and a height different formed between the first extend section 702 and the first connecting 703. Therefore, each first extend section 702 becomes a U shape structure. The second contacting sections 801 and the second extend sections 802 of the second terminal set 80 are disposed above the first extend sections 702 and the second contacting sections 801 and the first contacting sections 701 keep at the same level. Each second connecting section 803 extends and bends toward one end of the second extend section 802 and a height difference formed between the second extend section 802 and the section connecting section 803. The first terminal sides of the first contacting sections 701 and the second contacting sections 801 on the tongue plate 60 keep intervals from side wall 503 of the shell body 50 for plugging in the tongue plate 60 of the USB receptacle connector 1 so as to let the terminals contact to each other.

Figure 11:
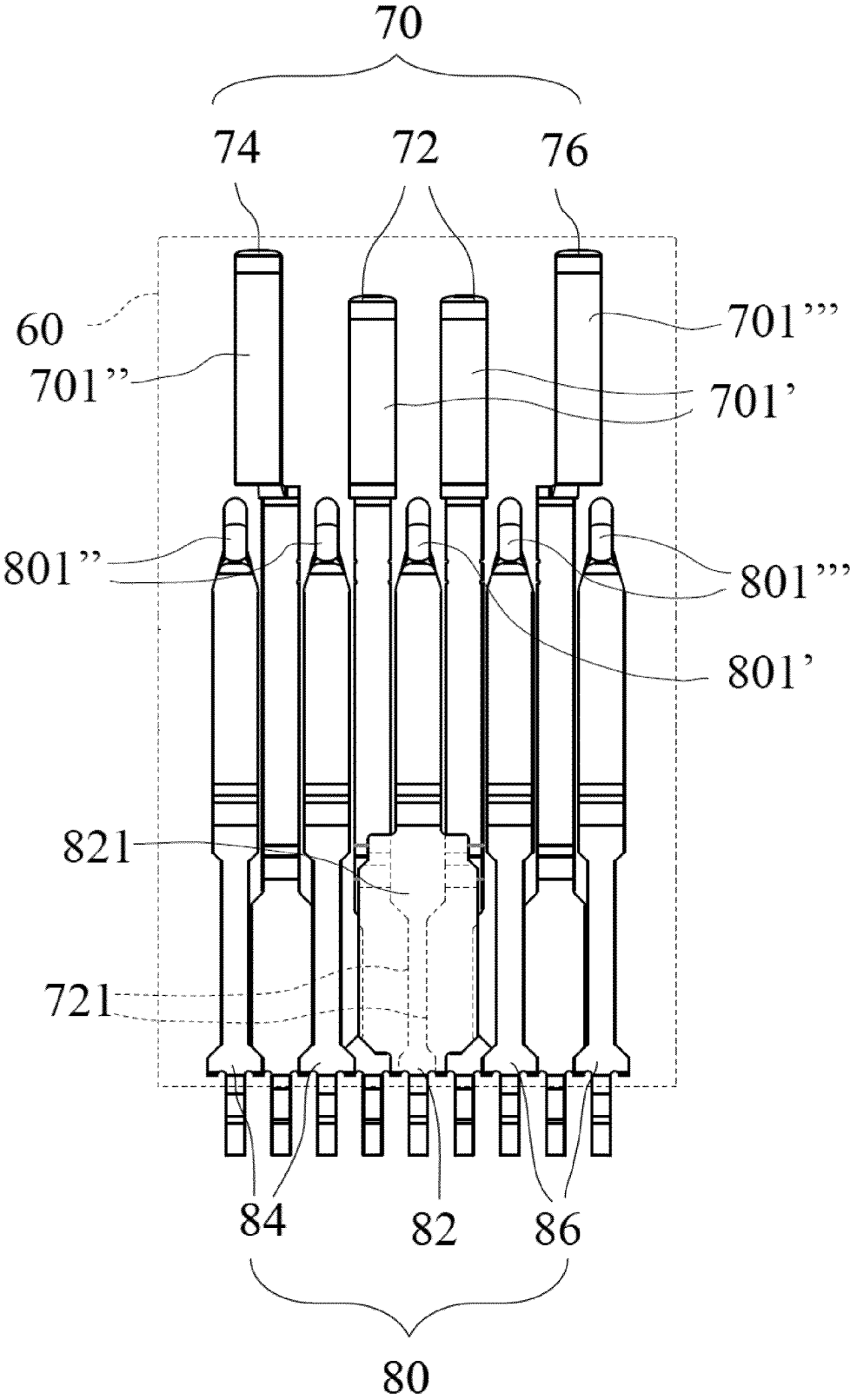
FIG. 11 is a transparent top view illustrating the first terminal set and the second terminal set in the first embodiment of the present invention.

Please refer to FIG. 11, it is a transparent top view illustrating the first terminal set and the second terminal set in the first embodiment of the present invention. As shown in FIG. 11, the first terminal set 70 includes a first pair of signal terminals 72 parallel to each other and disposed within two of the first terminal slots 6013 to expose the first contacting sections 701' on the top surface 6011 of the bottom plate 601. The first pair of the signal terminals 702 are half-duplex differential action signal lines (D+/D−) for transmitting or receiving signal in one direction. A power terminal 74 is parallel to the first pair of the signal terminals 72 and disposed within one of the first terminal slots 6013 of the tongue 60 to expose the first contacting section 701" on the top surface 6011 of the top plate 603. According to the transparent top view, the power terminal 74 is disposed at left side of the first pair of the signal terminals 72 for providing power. A ground terminal 76 is parallel to the first pair of the signal terminals 72 and disposed within one of the first terminal slots 6013 of the tongue plate 60 to expose the first contacting section 701'" on the top surface 6011 of the top plate 603. According to the transparent top view, the ground terminal 76 is disposed at right side of the first pair of the signal terminals 72 for providing a discharge path of the static electricity so as to avoid the damage of the electronic components. It should be noted that the first pair of the signal terminals 72, the power terminal 74 and the ground terminal 76 in the first terminal set 70 are the USB 2.0 contact points.

Please still refer to FIG. 11, the second terminal set includes a ground terminal 82 parallel to the first terminal set 70 and disposed within one of the second terminal slots 6033 of the tongue plate 60 to extend from the front end of the bottom plate 601 of the second contacting section 801'. A ground terminal 82 is used as a reference point for voltage level to provide a baseline potential. A second pair of signal terminals 84 are parallel to the first terminal set 70 and disposed within two of the second terminal slots 6033 of the tongue plate 60. According to the transparent top view, the second pair of the signal terminals is disposed at left side of the ground terminal 82 to extend the second contacting section 801''' at front end of the bottom plate 601. The second pair of the signal terminals 84 are simplex differential action signal lines to transmit signal in one direction. A third pair of signal terminals 86 are parallel to the first terminal set 70 and disposed within two of the second terminal slots 6033 of the tongue plate 70. According to the transparent top view, the third pair of the signal terminal 86 is disposed at right side of the ground terminal 82 to extend the second contacting sections 801''' in front end of the bottom plate 601. The third pair of the signal terminals 86 are simplex differential signal lines to transmit signal in one direction. It should be noted that the ground terminal 82, the second pair of the signal terminals 84 and the third pair of the signal terminal 86 in the second terminal set 86 are used for providing USB 3.0 contact points.

The ground terminal 82 is disposed at the connecting section 821 (i.e. the second connecting section 803 of the ground terminal 82) and widens at two sides. A portion of the ground terminal 82 covers the first signal terminal connecting sections 721 of the first signal terminal 72. Each of the first signal terminals 72 shifts internally, and the first signal terminal connecting sections 721 are disposed within the covering area of the connecting section 821. In accordance with the structure above, it is to avoid the crosstalk interference caused by the first pair of the signal terminals 72 in the second pair of the signal terminals 84 and the third pair of the signal terminals 86.

Figure 12:
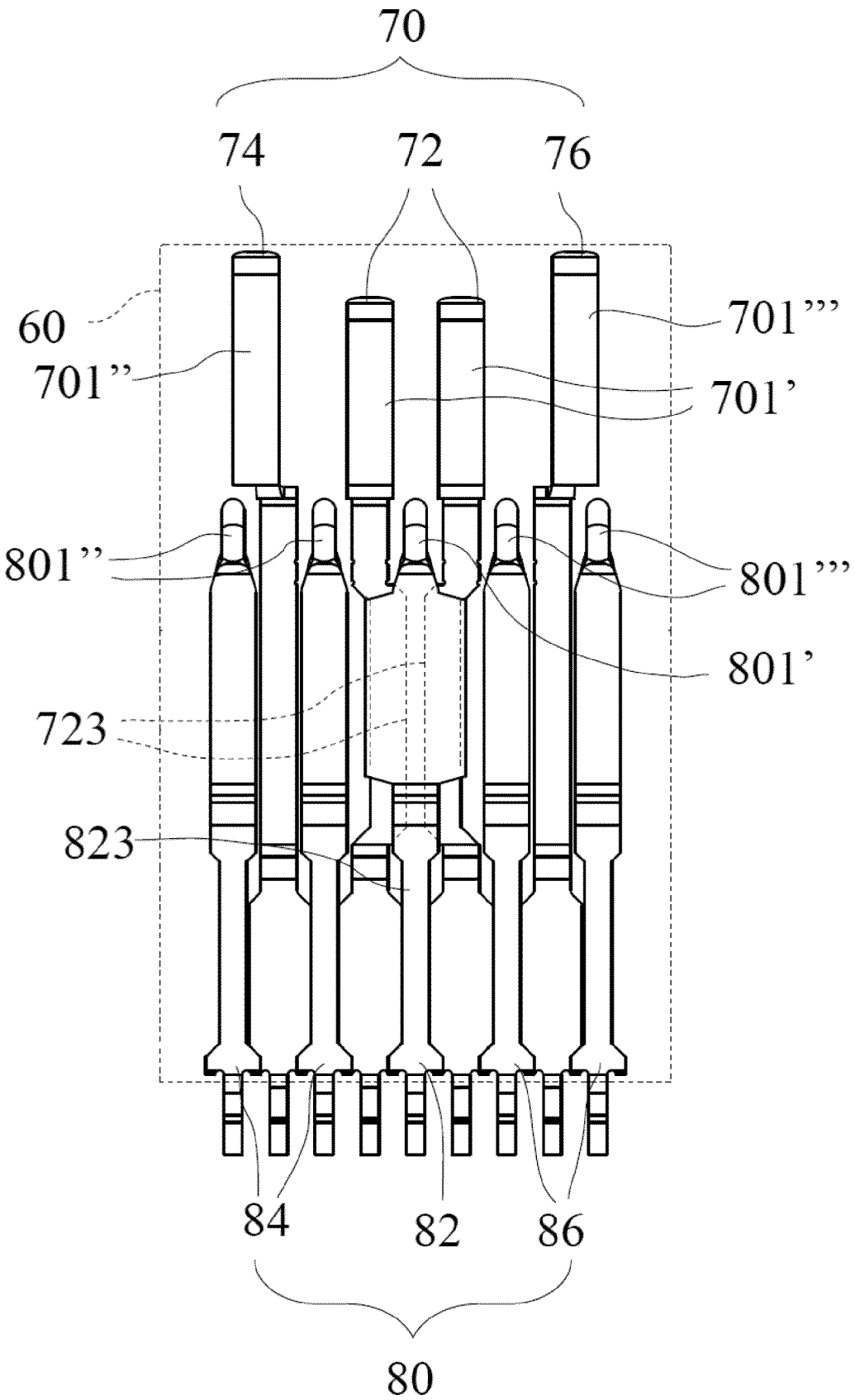
FIG. 12 is a transparent top view of the first terminal set and the second terminal set in the second embodiment of the present invention.

Please refer to FIG. 12, it is a transparent top view of the first terminal set and the second terminal set in the second embodiment of the present invention. As shown in FIG. 12, the difference of the USB plug connector 5 in the second embodiment from the previous first embodiment is that the extending section 823 (i.e. the second extending section 803) of the ground terminal 82 widens at two sides to cover the first signal terminal extending sections 723 (i.e. the first extending section 702) of the first pair of the signal terminals 72. Each of the first signal terminal extending sections 723 shifts internally to let the first signal terminal extending sections 723 in the covering area of the extending section 823. In accordance with the structure above, it is to avoid the crosstalk interference caused by the first pair of the signal terminals 72 in the second pair of the signal terminals 84 and the third pair of the signal terminals 86. The rest of the components in the second embodiment are the same as thereof in the first embodiment, the description thereof is omitted herein.

Figure 13:
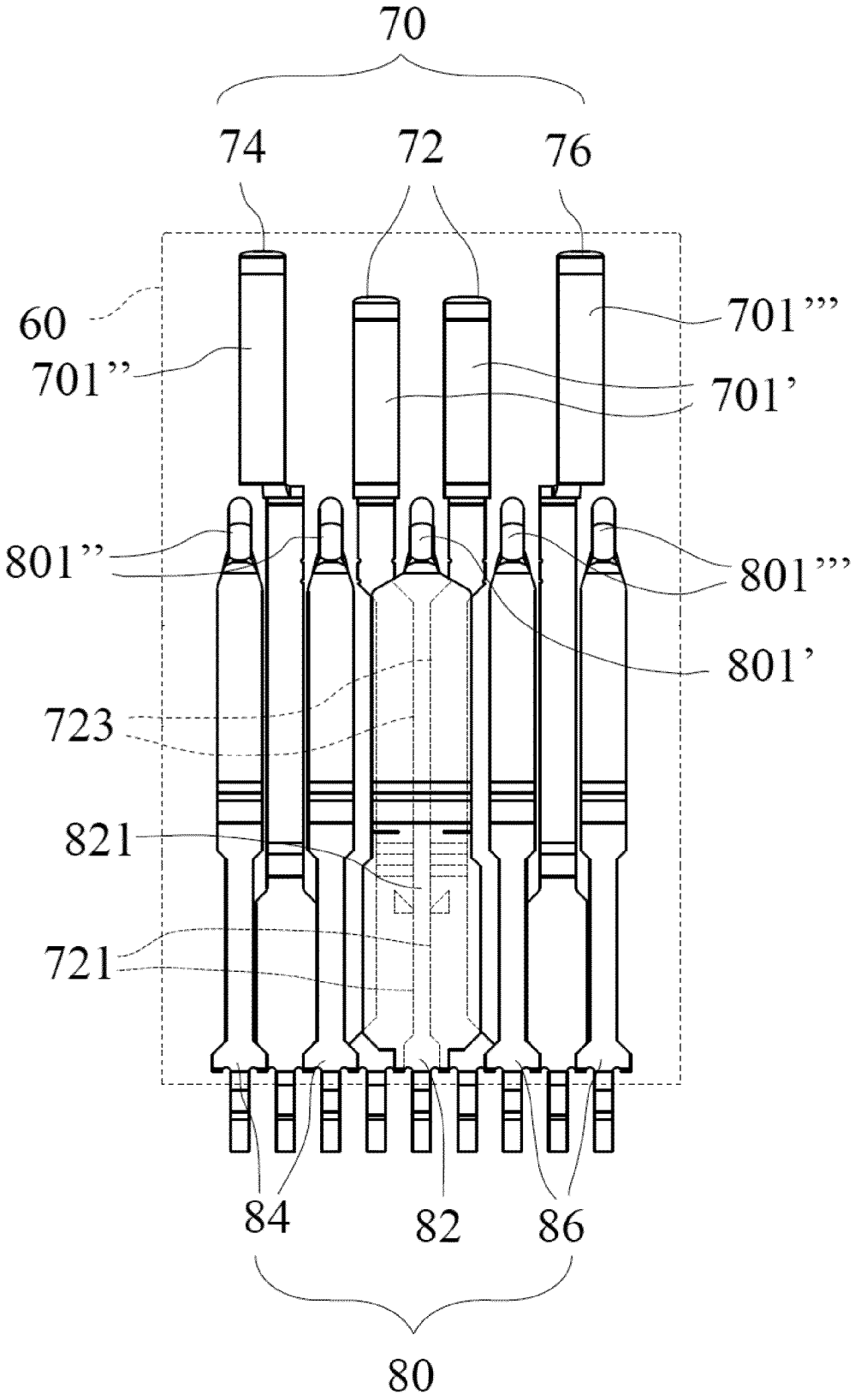
FIG. 13 is a transparent top view of the first terminal set and the second terminal set in the third embodiment of the present invention

Please refer to FIG. 13, it is a transparent top view of the first terminal set and the second terminal set in the third embodiment of the present invention. As shown in FIG. 13, the difference of the USB plug connector 5 in the third embodiment from the previous first and second embodiment is that the connecting section 821 of the ground terminal 82 is connected to a portion of the extending section 823 and widens at two sides to partially cover the connecting area where connecting section 721 of the first pair of the signal terminal 72 connected to a portion of the first signal terminal extending section 723. The connecting area where the connecting section 721 of the first pair of the signal terminal 72 connected to a portion of the first signal terminal extending section 723 shifts internally to let the connecting area where the connecting section 721 of the first pair of the signal terminal 72 connected to a portion of the first signal terminal extending section 723 in the covering area where the connecting section 821 of the ground terminal 82 connected to a portion of the extending section 823. In accordance with the structure above, it is to avoid the crosstalk interference caused by the first pair of the signal terminals 72 in the second pair of the signal terminals 84 and the third pair of the signal terminals 86. The rest of the components in the third embodiment are the same as thereof in the first embodiment, the description thereof is omitted herein.

According to the first, second, third and fourth embodiments of the USB plug connector 5 in the present invention, the connecting section 821 and the extending section 823 within the tongue plate 60 of the USB plug connector 5 are widened to reduce or avoid the crosstalk interference caused by the first pair of the signal terminals 72 in the second pair of the signal terminals 84 and the third pair of the signal terminals 86 so as to stabilize the transmission.

As described above, the present invention has been described with preferred embodiments thereof and it is understood that many changes and modifications to the described embodiments can be carried out without departing from the scope and the spirit of the invention that is intended to be limited only by the appended claims.

What is claimed is:

1. A receptacle connector comprising a tongue plate including a plurality of first terminal slots and a plurality of second terminal slots, a first terminal set with a plurality of terminals and each of the terminals includes a first contacting section, a first soldering section and a first connecting section for connecting the first contacting section and the first soldering section, the first terminal set disposed within the first terminal slots, a second terminal set with a plurality of terminals, each of the terminals includes a second contacting section, a second soldering section and a second connecting section for connecting the second contacting section and the second soldering section, wherein the receptacle connector is characterized in that:

the first terminal set comprises:

a first pair of signal terminals disposed within two of the first terminal slots of the tongue plate to expose the first contacting sections on the tongue plate;

a power terminal disposed within one of the first terminal slots of the tongue plate to expose the first contacting section on the tongue plate; and a ground terminal disposed within one of the first terminal slots of the tongue plate to expose the first contacting section on the tongue plate;

wherein the power terminal and the ground terminal are disposed at two sides of the first pair of the signal terminals;

the second terminal set comprises:

a second pair of signal terminals divided into a second internal signal terminal and a second external signal terminal, and the second pair of the signal terminals disposed within two of the second terminal slots of the tongue plate at right side of the ground terminal to expose the second contacting sections on the tongue plate; and a third pair of signal terminals divided into a third internal signal terminal and a third external signal terminal, and disposed within two of the second terminal slots of the tongue plate at left side of the ground terminal to expose the second contacting sections on the tongue plate;

wherein the second connecting section of the ground terminal widens at two sides and covers the two first connecting sections of the first pair of the signal terminals.

2. The receptacle connector according to claim 1, wherein the receptacle connector is a USB receptacle connector.

3. The receptacle connector according to claim 1, wherein the width of the second connecting section of the ground terminal is equal to the width of the two first connecting sections of the first pair of the signal terminals.

4. The receptacle connector according to claim 1, wherein a portion of the second connecting section of the ground terminal widens at two sides and the width thereof is smaller than the width of the two first connecting sections of the first pair of the signal terminals.

5. The receptacle connector according to claim 1, wherein a second connecting section of the second external signal terminal shifts to right side and is parallel to the second connecting section of the second internal signal terminal and the second connecting section of the third external signal terminal shifts to left side and is parallel to the second connecting section of the third internal signal terminal.

6. The receptacle connector according to claim 1, wherein each of the first contacting section in the first terminal set is disposed in an interval surrounded by each of the second contacting section and each of the second connecting section in the adjacent terminals of the second terminal set, and the first contacting sections of the first terminal set are not overlapped with the second contacting sections and the second connecting sections of the terminal in the second terminal set.

7. The receptacle connector according to claim 1, wherein the second connecting section of the second internal signal terminal bends at one side and surrounds right side of the second connecting section of the ground terminal with a distance and the second connecting section of the third internal signal terminal bends at one side and surrounds left side of the second connecting section of the ground terminal with a distance.

8. The receptacle connector according to claim 1, wherein the width of the second connecting section of the ground terminal is larger than the width of the two first connecting sections of the first pair of the signal terminals.

9. The receptacle connector according to claim 8, wherein the left side and right side of the second connecting section of the ground signal terminal bend toward a direction of the first pair of the signal terminals.

10. A plug connector comprising: a tongue plate including a plurality of first terminal slots and a plurality of second terminal slots, a first terminal set with a plurality of terminals and each of the terminals includes a first contacting section, a first extending section, a first soldering section and a first connecting section for connecting one end of the first extending section and one end of the first soldering section, the first contacting section is connected to the other end of the first extending section, the first terminal set disposed within the first terminal slots, a second terminal set with a plurality of terminals, each of the terminals includes a second contacting section, a second extending section, a second soldering section and a second connecting section for connecting one end of the second extending section and one end of the second soldering section, the second contacting section is connected to the other end of the second extending section, the second terminal set disposed within the second terminal slots, wherein the receptacle connector is characterized in that:

the first terminal set comprises:

a first pair of signal terminals disposed within two of the first terminal slots of the tongue plate to expose the first contacting sections on the tongue plate;

a power terminal disposed within one of the first terminal slots of the tongue plate to expose the first contacting section on the tongue plate; and a ground terminal disposed within one of the first terminal slots of the tongue plate to expose the first contacting section on the tongue plate;

wherein the power terminal and the ground terminal are disposed at two side of the first pair of the signal terminals;

the second terminal set comprises:

a ground terminal disposed within one of the second terminal slots of the tongue plate to expose the second contacting section on the tongue plate;

a second pair of signal terminals divided into a second internal signal terminal and a second external signal terminal, and the second pair of the signal terminals are disposed within one of the second terminal slots of the tongue plate at left side of the ground terminal to expose the second contacting sections on the tongue plate; and a third pair of signal terminals divided into a third internal signal terminal and a third external signal terminal, and disposed within two of the second terminal slots of the tongue plate at right side of the ground terminal to expose the second contacting sections on the tongue plate;

wherein the second connecting section of the ground terminal widens at two sides and covers the two first connecting sections of the first pair of the signal terminals.

11. The receptacle connector according to claim 10, wherein the first connecting sections of the first signal terminal shift toward internal side for the first connecting sections of the first signal terminal being a covering range in the second connecting section of the ground terminal.

* * * * *